US010549526B2

(12) United States Patent
Inoue et al.

(10) Patent No.: US 10,549,526 B2
(45) Date of Patent: Feb. 4, 2020

(54) IMAGE FORMING APPARATUS AND IMAGE FORMING METHOD

(71) Applicant: CANON KABUSHIKI KAISHA, Tokyo (JP)

(72) Inventors: Koji Inoue, Tokyo (JP); Jun Yasutani, Yokohama (JP); Nobuhiro Kitabatake, Tokyo (JP); Yoichi Takada, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/989,538

(22) Filed: May 25, 2018

(65) Prior Publication Data

US 2018/0345657 A1 Dec. 6, 2018

(30) Foreign Application Priority Data

Jun. 2, 2017 (JP) ..... 2017-110000

(51) Int. Cl.

| | |
|---|---|
| ***B41J 2/005*** | (2006.01) |
| ***B41J 2/045*** | (2006.01) |
| ***B41J 2/01*** | (2006.01) |
| ***B41M 5/025*** | (2006.01) |

(52) U.S. Cl.

CPC ..... *B41J 2/0057* (2013.01); *B41J 2/0457* (2013.01); *B41J 2/0458* (2013.01); *B41J 2/04576* (2013.01); *B41J 2/04581* (2013.01); *B41J 2002/012* (2013.01); *B41M 5/0256* (2013.01)

(58) Field of Classification Search

CPC .. B41J 11/002; B41J 2/0057; B41J 2002/012; B41J 2/01; B41J 29/38; B41J 2/0458; B41J 2/04581; B41J 2/0457; B41J 2/04576; B41M 5/0256; B41M 5/025; B41M 1/06

See application file for complete search history.

(56) References Cited

U.S. PATENT DOCUMENTS

2012/0098882 A1* 4/2012 Onishi ..... B41J 2/0057 347/18
2014/0218424 A1* 8/2014 Koitabashi ..... B41J 1/00 347/1

FOREIGN PATENT DOCUMENTS

JP 2015-202617 A 11/2015

* cited by examiner

*Primary Examiner* — Jannelle M Lebron
(74) *Attorney, Agent, or Firm* — Venable LLP

(57) ABSTRACT

An intermediate transfer body is efficiently heated, and thus, transfer properties of an image and durability of the intermediate transfer body are ensured. A heating unit heats the intermediate transfer body by using a plurality of heating sources which are positioned by being shifted, with respect to a rotation direction of the intermediate transfer body. The plurality of heating sources includes a first heating source and a second heating source. A degree of heating the intermediate transfer body by the second heating source is greater than a degree of heating the intermediate transfer body by the first heating source. The second heating source is positioned on an upstream side, with respect to the rotation direction of the intermediate transfer body, from the first heating source.

12 Claims, 14 Drawing Sheets

IMAGE FORMING APPARATUS AND IMAGE FORMING METHOD

BACKGROUND OF THE INVENTION

Field of the Invention

The present invention relates to an image forming apparatus and an image forming method in which an image is formed by using a rotating intermediate transfer body.

Description of the Related Art

In Japanese Patent Laid-Open No. 2015-202617, an image forming method is described in which an ink is supplied onto a surface of a rotating intermediate transfer body, and an image is formed, and then, the image on the surface of the intermediate transfer body is transferred to a printing medium, while heating the intermediate transfer body with an infrared ray heater.

SUMMARY OF THE INVENTION

In Japanese Patent Laid-Open No. 2015-202617, in order to increase transfer properties of an image, the intermediate transfer body is heated by using a single infrared ray heater. Therefore, in order to heat the intermediate transfer body to a desired temperature in a limited rotation range of the intermediate transfer body, the single infrared ray heater rapidly heats the intermediate transfer body. For this reason, there is a concern that durability of the intermediate transfer body is impaired. In particular, in a case where an ink, and a reaction liquid for thickening the ink are supplied onto the surface of the intermediate transfer body, it is necessary to rapidly heat the intermediate transfer body. In the case of increasing a heating temperature of the intermediate transfer body, there is a concern that the durability of the intermediate transfer body decreases due to a chemical reaction between a component such as an acid, contained in such a reaction liquid, and the intermediate transfer body. In the case of decreasing the heating temperature of the intermediate transfer body, it takes a long period of time until the intermediate transfer body is heated to a desired temperature, and thus, a throughput decreases.

The invention provides an image forming apparatus and an image forming method in which transfer properties of an image and durability of an intermediate transfer body can be ensured by efficiently heating the intermediate transfer body.

In the first aspect of the present invention, there is provided an image forming apparatus, comprising an ink supply unit configured to supply an ink onto a surface of an intermediate transfer body, a heating unit configured to heat the intermediate transfer body, and a transfer unit configured to transfer the ink on the surface of the intermediate transfer body to a printing medium, the ink supply unit, heating unit, and transfer unit being successively arranged along a rotation direction of the intermediate transfer body, wherein the heating unit includes a plurality of heating sources which are positioned by being shifted in the rotation direction, and the plurality of heating sources include a first heating source heating the intermediate transfer body and a second heating source heating the intermediate transfer body, a degree of heating the intermediate transfer body by the second heating source being higher than a degree of heating the intermediate transfer body by the first heating source, the second heating source being positioned on an upstream side in the rotation direction from the first heating source.

In the second aspect of the present invention, there is provided an image forming method, comprising:

a step of supplying an ink onto a surface of an intermediate transfer body which rotates in a predetermined direction;

a heating step of heating the surface of the intermediate transfer body onto which the ink is supplied; and a transfer step of transferring the ink on the surface of the intermediate transfer body to a printing medium, wherein in the heating step, the intermediate transfer body is heated by a plurality of heating sources including a first heating source and a second heating source which are positioned by being shifted in the predetermined direction, and the second heating source heats the intermediate transfer body with a degree of heating higher than a degree of heating by the first heating source with which the intermediate transfer body is heated, the second heating source being positioned on an upstream side in the rotation direction from the first heating source.

According to the invention, it is possible to ensure transfer properties of an image and durability of an intermediate transfer body by efficiently heating the intermediate transfer body with a plurality of heating sources.

Further features of the present invention will become apparent from the following description of exemplary embodiments with reference to the attached drawings.

DESCRIPTION OF THE EMBODIMENTS

Hereinafter, the invention will be described in detail by using preferred embodiments. The invention can be applied to a transfer type ink jet printing apparatus (an ink jet type image forming apparatus) in which an image is formed on a transfer body, and the image is transferred to a printing medium. Hereinafter, a basic configuration of the transfer type ink jet printing apparatus, to which the invention can be applied, will be described, before describing the embodiments of the invention.

(1) Basic Configuration of Transfer Type Ink Jet Printing Apparatus

Figure 1:
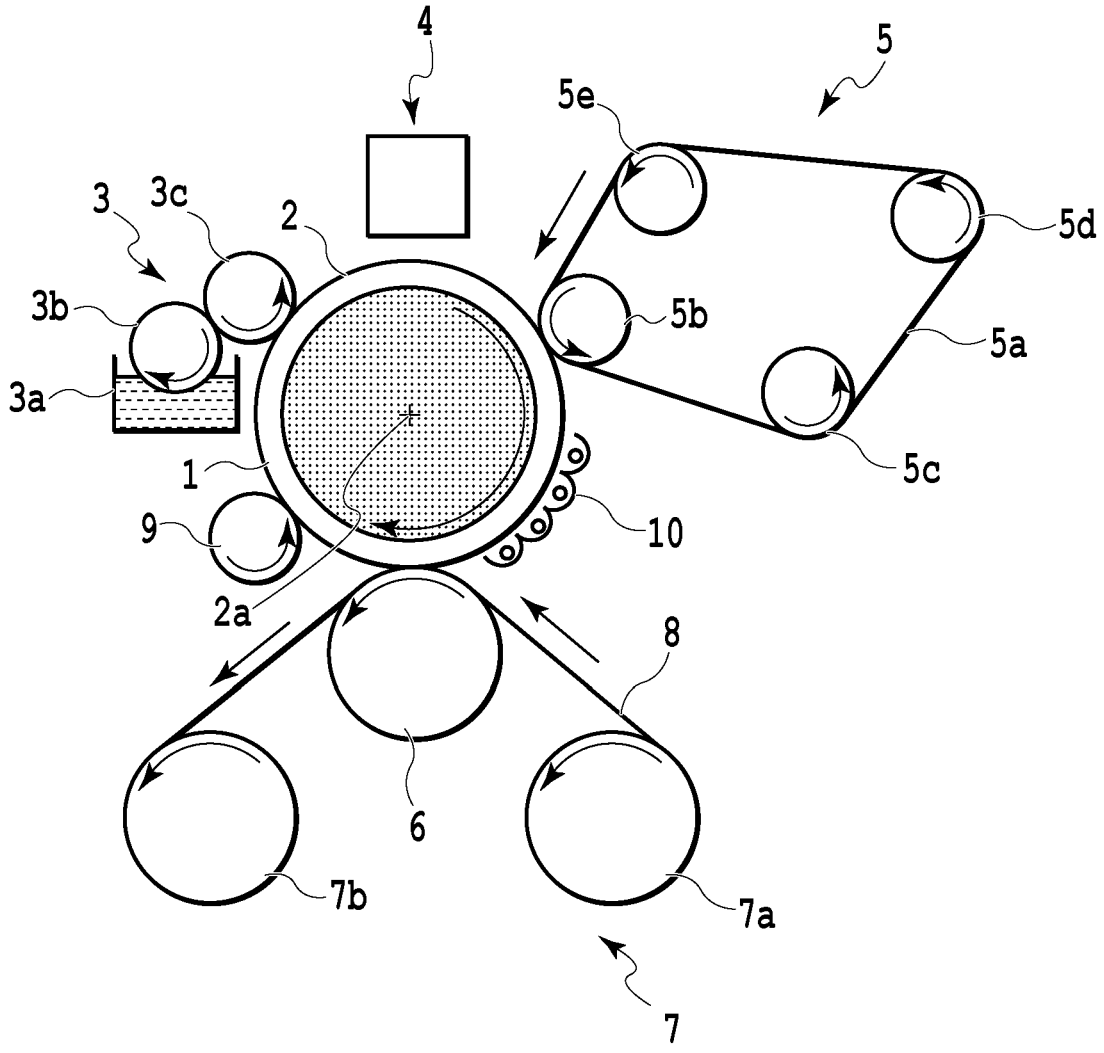
FIG. 1 is an explanatory diagram of a basic configuration of an image forming apparatus to which the invention can be applied.

FIG. 1 is a schematic view of a transfer type ink jet printing apparatus to which the invention can be applied.

In the transfer type ink jet printing apparatus of this example, a reaction liquid is supplied to an intermediate transfer body 1 which is supported on a support member 2, by a reaction liquid supplying unit 3, and an ink is supplied onto the intermediate transfer body 1 to which the reaction liquid is supplied, by an ink supplying unit 4, and thus, an image is formed. A liquid component is absorbed from the image of the intermediate transfer body 1 by a liquid absorption unit 5, and radiation heat is applied to the intermediate transfer body 1 by a radiation heating unit 10, and thus, the intermediate transfer body 1 is heated. The image on the intermediate transfer body 1 from which the liquid component is removed, is transferred onto a printing medium 8 such as paper, by a transfer unit 6. In addition, as necessary, an intermediate transfer body cleaning unit 9 cleaning the surface of the intermediate transfer body 1 after the transfer, may be provided.

The support member 2 rotates in a predetermined direction of an arrow around a rotation axis 2*a*, and thus, the intermediate transfer body 1 moves along with the support member 2. The reaction liquid of the reaction liquid supplying unit 3 and the ink of the ink supplying unit 4 are sequentially supplied to the moving intermediate transfer body 1, and thus, the image is formed on the intermediate transfer body 1. The image formed on the intermediate transfer body 1 moves to a position in contact with a liquid absorption member 5*a* of the liquid absorption unit 5, according to the movement of the intermediate transfer body 1. The intermediate transfer body 1 and the liquid absorption unit 5 move in synchronization with each other, and the image formed on the intermediate transfer body 1 moves while maintaining a contact state with the liquid absorption member 5*a*. Meanwhile, the liquid absorption member 5*a* removes the liquid component from the image.

In the image on the intermediate transfer body 1, the contact state with the liquid absorption member 5*a* is maintained, and thus, most of the liquid component is removed from the image. In order to allow the liquid absorption member 5*a* to more effectively function, a pressure contact state is preferable in which the image on the intermediate transfer body 1 is in contact with the liquid absorption member 5*a* with a predetermined pressing force. Removing the liquid component from the image on the intermediate transfer body 1 may be condensing the ink forming the image on the intermediate transfer body 1. The condensation of the ink indicates that a content ratio of a solid content contained in the ink, such as a color material or a resin, with respect to the liquid component, increases, as the liquid component contained in the ink decreases.

The image from which the liquid component in the ink is removed, passes through a position facing the radiation heating unit 10 according to the movement of the intermediate transfer body 1, and is heated by the radiation heat. According to such heating, a resin component contained in the ink is melted, and is changed to be in a film state which is necessary for forming the image. The heated image moves to a transfer position in contact with the printing medium according to the movement of the intermediate transfer body 1, and the image is in pressure contact with the printing medium 8 by a transport unit 7 of the printing medium, and thus, is transferred to the printing medium 8.

Hereinafter, each constituent of the transfer type ink jet printing apparatus of this example will be described.

(1-1) Intermediate Transfer Body

The intermediate transfer body 1 includes a surface layer including an image forming surface on which the image is formed. Various materials, such as a resin and ceramic, can be suitably used as a member of the surface layer, and a material having a high compressive elastic modulus is preferable from the viewpoint of durability, or the like. Specifically, examples of the material include a condensate obtained by condensing an acrylic resin, an acryl silicone resin, a fluorine-containing resin, and a hydrolyzable organic silicon compound, and the like. In order to improve wettability, transfer properties, and the like, of the reaction liquid, the intermediate transfer body 1 may be subjected to a surface treatment. Examples of the surface treatment include a frame treatment, a corona treatment, a plasma treatment, a grinding treatment, a roughening treatment, an active energy ray irradiation treatment, an ozone treatment, a surfactant treatment, a silane coupling treatment, and the like. A plurality of treatments may be combined. In addition, the surface layer of the intermediate transfer body 1 can be formed into the shape of an arbitrary surface.

In addition, it is preferable that the intermediate transfer body 1 includes a compressive layer having a function of absorbing a pressure variation. The compressive layer absorbs a modification, and thus, when a local pressure variation occurs in the intermediate transfer body 1, the variation is dispersed, and excellent transfer properties can be maintained even at the time of rapid printing. Examples of a forming member of the compressive layer include acrylonitrile-butadiene rubber, acryl rubber, chloroprene rubber, urethane rubber, silicone rubber, and the like. It is preferable that a predetermined amount of a vulcanizing agent, a vulcanizing accelerator, or the like is compounded at the time of molding the rubber material, and a filler such as a foaming agent, hollow fine particles, or a dietary salt is compounded as necessary, and thus, a porous structure is formed. Accordingly, when various pressure variations occur, an air bubble portion of the compressive layer is compressed according to a volume change, and a modification amount in a direction other than a compression direction is small, and thus, more stable transfer properties and more stable durability can be obtained. Examples of a porous rubber material include a material having a continuous pore structure in which pores are continuous to each other, and a material having an independent pore structure in which pores are independent from each other. In the invention, the porous rubber material may have any structure, and such structures may be combined.

Further, it is preferable that the intermediate transfer body 1 includes an elastic layer between the surface layer and the compressive layer. Various materials such as a resin or ceramic can be suitably used as a forming member of the elastic layer. Various elastomer materials, and various rubber materials are preferable from the viewpoint of processing properties or the like. Specifically, examples of the material include fluorosilicone rubber, phenyl silicone rubber, fluorine rubber, chloroprene rubber, urethane rubber, nitrile rubber, ethylene propylene rubber, natural rubber, styrene rubber, isoprene rubber, butadiene rubber, a copolymer of ethylene/propylene/butadiene, nitrile butadiene rubber, and the like. In particular, silicone rubber, fluorosilicone rubber, and phenyl silicone rubber have small compression permanent deformation, and thus, are preferable from the viewpoint of dimensional stability and durability. In addition, silicone rubber, fluorosilicone rubber, and phenyl silicone rubber have a small change in an elastic modulus according to a temperature, and thus, are preferable from the viewpoint of transfer properties. Further, in order to increase heating efficiency of radiation heating, it is desirable that a substance having a high infrared ray absorption efficiency such as carbon black is kneaded in the elastic layer.

In addition, various adhesive agents or various double-faced tapes for fixing and retaining the surface layer, the elastic layer, and the compressive layer of the intermediate transfer body 1, may be provided therebetween. In addition, in order to suppress lateral extension of the intermediate transfer body 1 and to retain strong tensility of the intermediate transfer body 1 at the time of mounting the intermediate transfer body 1 on the apparatus, a reinforcement layer having a high compressive elastic modulus may be provided on the intermediate transfer body 1. A woven cloth may be used as the reinforcement layer. The intermediate transfer body 1 can be prepared by arbitrarily combining each of the layers formed by various materials described above. The size of the intermediate transfer body 1 can be freely selected according to the size of the image to be recorded. The shape of the intermediate transfer body 1 is not particularly limited, and for example, can be a sheet shape, a roller shape, a belt shape, an endless web shape, and the like.

(1-2) Support Member

The intermediate transfer body 1 of this example is supported on the support member 2, and various adhesive agents, various double-faced tapes, or the like can be used as a support method. Alternatively, an installation member of a metal, ceramic, a resin, or the like may be attached to the intermediate transfer body 1, and the intermediate transfer body 1 may be supported on the support member 2 by using the installation member.

In the support member 2, a certain degree of structural strength is demanded from the viewpoint of a transport accuracy and durability. A metal, ceramic, a resin, or the like is preferably used as a material of the support member 2. In particular, in order to improve control responsiveness by reducing inertia at the time of an operation, in addition to rigidity against pressurization at the time of transfer, and a dimensional accuracy, aluminum, iron, stainless steel, an acetal resin, an epoxy resin, polyimide, polyethylene, polyethylene terephthalate, nylon, polyurethane, silica ceramics, and alumina ceramics can be preferably used as the material of the support member 2. In addition, it is preferable that such materials are used by being combined.

(1-3) Reaction Liquid Supplying Unit

The reaction liquid supplying unit 3 supplying the reaction liquid to the intermediate transfer body 1 includes a reaction liquid containing portion 3*a* containing the reaction liquid, and reaction liquid supply members 3*b* and 3*c* for supplying the reaction liquid in the reaction liquid containing portion 3*a* onto the intermediate transfer body 1. Various known apparatuses of the related art can be suitably used as the reaction liquid supplying unit 3. Specifically, as with the reaction liquid supplying unit 3 of FIG. 1, examples of the known apparatus include an apparatus using a gravure offset roller, an apparatus using an ink jet head (a liquid ejecting head), an apparatus adopting a supply manner such as die coating or blade coating, and the like. The reaction liquid supplied by the reaction liquid supplying unit 3 is supplied to the intermediate transfer body 1, and then, is in contact with the ink, and thus, thickens the ink. That is, the reaction liquid contains an ink thickening component thickening the ink.

(1-4) Reaction Liquid

The reaction liquid contains the ink thickening component. A color material, a resin, or the like, which is a part of a composition configuring the ink, is in contact with the ink thickening component, and is subjected to a chemical reaction or physical adsorption, and thus, the ink thickens. According to such a phenomenon, there is a case where a viscosity of the entire ink increases, and a case where a part of the component configuring the ink, such as a color material, is aggregated, and thus, the viscosity locally increases. Such an ink thickening component decreases fluidity of a part of the ink and/or the ink composition on the printing medium, and suppresses bleeding and beading at the time of forming the image. A known ink thickening component containing an organic acid can be used as the ink thickening component. It is preferable that the content of the ink thickening component in the reaction liquid is greater than or equal to 5% mass with respect to the total mass of the reaction liquid.

Examples of the organic acid include an oxalic acid, a polyacrylic acid, a formic acid, an acetic acid, a propionic acid, a glycolic acid, a malonic acid, a malic acid, a maleic acid, an ascorbic acid, a levulinic acid, a succinic acid, a glutaric acid, a glutamic acid, a fumaric acid, a citric acid, a tartaric acid, a lactic acid, a pyrrolidone carboxylic acid, a pyrone carboxylic acid, a pyrrole carboxylic acid, a furan-carboxylic acid, a pyridine carboxylic acid, a coumaric acid, a thiophene carboxylic acid, a nicotinic acid, an oxysuccinic acid, a dioxysuccinic acid, and the like.

The reaction liquid may contain a moderate amount of water and organic solvent. Water deionized by ion exchange or the like is preferable as water used in such a case. The organic solvent used in the reaction liquid is not particularly limited, and a known organic solvent can be used. In addition, it is possible to suitably adjust a surface tension and a viscosity of the reaction liquid by adding a surfactant and a viscosity adjuster to the reaction liquid, and at this time, a material to be added is not particularly limited insofar as being capable of coexisting with the ink thickening component. Specifically, examples of the surfactant which can be used, include an acetylene glycol ethylene oxide additive (Acetylenol E100, manufactured by Kawaken Fine Chemicals Co., Ltd.), a perfluoroalkyl ethylene oxide additive (Megaface F444, manufactured by DIC Corporation), and the like.

(1-5) Ink Supplying Unit

In the ink supplying unit 4 of this example, an ink jet head (a liquid ejection head) which is capable of ejecting the ink, is used. Examples of an ejection aspect of the ink in the ink jet head, include an aspect in which the ink is foamed by an electrothermal conversion element (a heater), and foaming energy thereof is used, an aspect in which an electromechanical conversion element such as a piezo element is used, or an aspect in which static electricity is used, or the like. In the ink supplying unit 4, a known ink jet head can be used. In particular, an ink jet head using an electrothermal conversion element as an ejection energy generating element is preferable, from the viewpoint of rapidly printing an image having a high density. The ink supplying unit 4 supplies a necessary amount of ink to an image forming position on the basis of a printing signal, and thus, forms the image.

An ink supply amount can be represented by an image density (duty) or an ink thickness. In this example, an average value obtained by multiplying a mass of an ink droplet forming an ink dot and the number of supplies (the number of ejections) of the ink droplet necessary for printing an image, and by dividing the value by a forming surface area of the image, is set to an ink supply amount ($g/m^2$). In this example, a maximum ink supply amount in an image forming region is set as the ink supply amount supplied in an area of at least greater than or equal to 5 $mm^2$, from the viewpoint of removing a liquid in the ink.

In order to supply an ink of each color onto the intermediate transfer body 1, a plurality of ink jet heads may be used in the ink supplying unit 4. For example, in the case of forming the image by using a yellow ink, a magenta ink, a cyan ink, and a black ink, four ink jet heads for ejecting four types of inks onto the intermediate transfer body 1 are used in the ink supplying unit 4. In addition, in the ink supplying unit 4, an ink jet head ejecting an ink not containing a color material (a clear ink) may be used.

(1-6) Ink

The ink contains the following components.

(1-6-1) Color Material

A pigment, or a mixture of a dye and a pigment can be used as the color material contained in the ink. The type of pigment which can be used as the color material, is not particularly limited. Specific examples of the pigment are capable of including an inorganic pigment such as carbon black, and an organic pigment such as azo, phthalocyanine, quinacridone, isoindolinone, imidazolone, diketopyrrolopyrrole, and dioxazine. One type or two or more types of pigments can be used, as necessary. In addition, the type of dye which can be used as the color material, is not particularly limited. Specific examples of the dye are capable of including a direct dye, an acidic dye, a basic dye, a dispersion dye, an edible dye, and the like, and a dye having an anionic group can be used. Specific examples of a dye skeleton include azo, triphenyl methane, phthalocyanine, azaphthalocyanine, xanthene, anthrapyridone, and the like.

The content of the pigment in the ink is preferably greater than or equal to 0.5% mass and less than or equal to 15.0% mass, and is more preferably greater than or equal to 1.0% mass and less than or equal to 10.0% mass, with respect to the total mass of the ink.

(1-6-2) Dispersant

A known dispersant used in an ink for an ink jet head can be used as a dispersant for dispersing the pigment. For example, a water-soluble dispersant having both of a hydrophilic portion and a hydrophobic portion in a structure is preferable. In particular, a pigment dispersant formed of a resin in which at least a hydrophilic monomer and a hydrophobic monomer are copolymerized, is preferable. Such a monomer is not particularly limited, and a known monomer can be used. Specifically, examples of the hydrophobic monomer include styrene, a styrene derivative, alkyl (meth) acrylate, benzyl (meth)acrylate, and the like. In addition, examples of the hydrophilic monomer include an acrylic acid, a methacrylic acid, a maleic acid, and the like.

It is preferable that an acid value of the dispersant is greater than or equal to 50 mgKOH/g and less than or equal to 550 mgKOH/g. In addition, it is preferable that a weight average molecular weight of the dispersant is greater than or equal to 1000 and less than or equal to 50000. In addition, it is preferable that a mass ratio of the pigment to the dispersant (Pigment:Dispersant) is in a range of 1:0.1 to 1:3. In addition, a so-called self-dispersion pigment can be used in which the pigment itself is subjected to surface reformation to be dispersible without using the dispersant.

(1-6-3) Resin Fine Particles

The ink can be used by containing various fine particles not containing the color material. For example, improvement in appearance quality and fixing properties of the image can be expected by containing resin fine particles.

A material of the resin fine particles is not particularly limited, and a known resin can be suitably used. Specifically, examples of the material include a homopolymerized product such as polyolefin, polystyrene, polyurethane, polyester, polyether, polyurea, polyamide, polyvinyl alcohol, a poly (meth)acrylic acid and a salt thereof, poly(meth)acrylic acid alkyl, and polydiene, or a copolymerized product in which a plurality of monomers generating the homopolymerized products are combined and polymerized. It is preferable that a weight average molecular weight (Mw) of the resin is in a range of greater than or equal to 1,000 and less than or equal to 2,000,000. In addition, the amount of resin fine particles in the ink is preferably greater than or equal to 1% mass and less than or equal to 50% mass, and is more preferably greater than or equal to 2% mass and less than or equal to 40% mass, with respect to the total mass of the ink.

In addition, it is preferable that the resin fine particles are used as a resin fine particle dispersion element in which the resin fine particles are dispersed in a liquid. A dispersion method is not particularly limited. For example, a so-called self-dispersion type resin fine particle dispersion element dispersed by using a resin in which a monomer having a dissociable group is homopolymerized or a plurality of types of monomers are copolymerized, is preferable. Examples of the dissociable group include a carboxyl group, a sulfonic acid group, a phosphoric acid group, and the like, and examples of the monomer having such a dissociable group include an acrylic acid, a methacrylic acid, or the like. In addition, a so-called emulsified dispersion type resin fine particle dispersion element in which the resin fine particles are dispersed by an emulsifier, can be preferably used. A known surfactant can be preferably used as the emulsifier, regardless of a low molecular weight or a high molecular weight. A nonionic surfactant, or a surfactant having the same electric charge as that of the resin fine particles is preferable as the surfactant.

A dispersion particle diameter of the resin fine particle dispersion element is preferably greater than or equal to 10 nm and less than or equal to 1000 nm, and is more preferably greater than or equal to 100 nm and less than or equal to 500 nm. In addition, when the resin fine particle dispersion element is prepared, it is preferable that various additives are added in order for stabilization. For example, n-heptadecane, dodecyl methacrylate, stearyl methacrylate, chlorobenzene, dodecyl mercaptan, blue dye, polymethyl methacrylate, and the like are preferable as the additive.

(1-6-4) Surfactant

The ink may contain a surfactant, and examples of the surfactant include an acetylene glycol ethylene oxide additive (Acetylenol E100, manufactured by Kawaken Fine Chemicals Co., Ltd.), and the like. It is preferable that the amount of surfactant in the ink is greater than or equal to 0.01% mass and less than or equal to 5.0% mass with respect to the total mass of the ink.

(1-6-5) Water and Water-Soluble Organic Solvent

Water and/or a water-soluble organic solvent can be contained as the solvent of the ink. Water deionized by ion exchange, or the like, is preferable as water. In addition, it is preferable that the content of water in the ink is greater than or equal to 30% mass and less than or equal to 97% mass the total mass of the ink.

The type of water-soluble organic solvent is not particularly limited, and a known organic solvent can be used. Specifically, examples of the water-soluble organic solvent include glycerin, diethylene glycol, polyethylene glycol, polypropylene glycol, ethylene glycol, propylene glycol, butylene glycol, triethylene glycol, thiodiglycol, hexylene glycol, ethylene glycol monomethyl ether, diethylene glycol monomethyl ether, 2-pyrrolidone, ethanol, methanol, and the like. In addition, two or more types of solvents selected therefrom can be used by being mixed. It is preferable that the content of the water-soluble organic solvent in the ink is greater than or equal to 3% mass and less than or equal to 70% mass with respect to the total mass of the ink.

(1-6-6) Other Additives

The ink may contain various additives such as a pH adjuster, an anticorrosive agent, an antiseptic agent, a mildew-proof agent, an antioxidant, a reduction inhibitor, a water-soluble resin and a neutralizer thereof, and a viscosity adjuster, in addition to the components described above, as necessary.

(1-7) Liquid Absorption Unit

The liquid absorption unit 5 removes the liquid component from the image on the intermediate transfer body 1, which is formed by the thickened ink. Accordingly, it is possible to suppress a problem which occurs in the residual liquid component contained in the image, for example, the occurrence of curl and cockling after the image is transferred to the printing medium such as paper, and the occurrence of image distortion due to an offset of the ink with respect to the printing medium such as stacked paper.

The liquid absorption unit 5 includes the liquid absorption member 5*a*, and a pressing member 5*b* which presses the liquid absorption member 5*a* against the image on the intermediate transfer body 1. In addition, the shape of the liquid absorption member 5*a* and the pressing member 5*b* is not particularly limited. For example, as illustrated in FIG. 1, the pressing member 5*b* may be in the shape of a cylinder, the liquid absorption member 5*a* may be in the shape of a belt, and the belt-like liquid absorption member 5*a* may be pressed against the intermediate transfer body 1 by the cylindrical pressing member 5*b*. Alternatively, the pressing member 5*b* may be in the shape of a cylinder, the liquid absorption member 5*a* may be in the shape of a tube formed on a circumferential surface of the cylindrical pressing member 5*b*, and the tubular liquid absorption member 5*a* may be pressed against the intermediate transfer body 1 by the cylindrical pressing member 5*b*. In addition, the liquid absorption unit 5 may include a stretching member stretching the liquid absorption member. Stretching rollers 5*c*, 5*d*, and 5*e* of FIG. 1 are the stretching member.

The liquid absorption unit 5 brings the liquid absorption member 5*a* including a porous body into pressure contact with the image by the pressing member 5*b*, and thus, the liquid component contained in the image is absorbed in the liquid absorption member 5*a*, and the liquid component is removed from the image. Various methods used in the related art such as a method of heating, a method of blowing low humidity air, and a method of depressurizing may be combined as a method of removing the liquid component in the image, in addition to the method of bringing the liquid absorption member into pressure contact with the image, as with this example.

Hereinafter, various conditions and various configurations of the liquid absorption unit 5 will be described.

(1-7-1) Pre-Treatment

It is preferable that a pre-treatment is performed by a pre-treatment unit (not illustrated) supplying the treatment liquid to the liquid absorption member 5*a* before the liquid absorption member 5*a* including the porous body is in contact with the image. It is preferable that the treatment liquid contains water and the water-soluble organic solvent, and water deionized by ion exchange or the like is preferable as water. The type of water-soluble organic solvent is not particularly limited, and for example, a known organic solvent such as ethanol or isopropyl alcohol can be used. In the pre-treatment of the liquid absorption member 5*a*, a method of supplying the treatment liquid is not particularly limited. For example, it is preferable that the treatment liquid is supplied by dipping or dropping of a liquid droplet.

(1-7-2) Pressurization Condition

A pressure of the liquid absorption member 5*a* which is in pressure contact with the image on the intermediate transfer body 1 is set to be greater than or equal to 0.3 $kgf/cm^2$, and thus, it is possible to perform solid-liquid separation with respect to the liquid component in the image for a shorter period of time, and to remove the liquid component. The pressure of the liquid absorption member 5*a* with respect to the intermediate transfer body 1 is a nip pressure between the intermediate transfer body 1 and the liquid absorption member 5*a*, a surface pressure is measured by using a surface pressure distribution meter (I-SCAN, manufactured by NITTA Corporation), and the pressure is obtained by dividing a load in a pressurized region by an area.

(1-7-3) Action Time

It is preferable that action time for bringing the liquid absorption member 5*a* into contact with the image is shorter than or equal to 50 ms, in order to suppress the attachment of the color material in the image with respect to the liquid absorption member 5*a*. The action time is obtained by dividing a pressure sensing range of the intermediate transfer body 1 in a movement direction at the time of measuring the surface pressure described above, by a movement rate of the intermediate transfer body 1. Hereinafter, the action time will be also referred to as liquid absorption nip time.

(1-7-4) (Method of Removing Liquid from Liquid Absorption Member)

The liquid component absorbed in the liquid absorption member 5*a* from the image is removed from the liquid absorption member 5*a* by known means. Examples of the removing method include a method of heating, a method of blowing low humidity air, a method of depressurizing, a method of narrowing the porous body, and the like.

(1-7-5) Porous Body

It is preferable that a pore diameter of the porous body of the liquid absorption member 5*a* is small, in order to suppress the attachment of the color material of the ink with respect to the porous body, and it is preferable that at least the pore diameter of the porous body on a side in contact with the image is less than or equal to 10 μm. In this example, the pore diameter is an average diameter, and can be measured by known means such as a mercury intrusion method, a nitrogen adsorption method, and an SEM image observe.

In addition, in order to allow the porous body to have evenly high air permeability, it is preferable to set the thickness thereof to be thin. The air permeability can be represented by a Gurley value defined in "paper and paper board-air permeability and air impermeability test method (intermediate region)-Gurley method", and it is preferable that the Gurley value is less than or equal to 10 seconds. The shape of the porous body is not particularly limited, and for example, the porous body may be in the shape of a roller, a belt, or the like. In addition, the porous body is set to be thin, and thus, in a case where there is a concern that capacity necessary for absorbing the liquid component is not capable of being sufficiently ensured, the porous body may have a multilayer configuration. In addition, in the liquid absorption member 5*a*, a layer which is in contact with the image on the intermediate transfer body 1, may be formed by the porous body, and a layer which is not in contact with the image on the intermediate transfer body 1 may be not the porous body.

The porous body is capable of having a laminated structure including a first layer and a second layer, and a laminated structure including the first layer, the second layer, and a third layer. The first layer is a layer on a side in contact with the image. Hereinafter, the first layer, the second layer, and the third layer will be described.

(1-7-5-1) First Layer

A material of the first layer is not particularly limited. It is preferable to use a fluorine resin having low surface free energy, from the viewpoint of suppressing the attachment of the color material, and in order to improve cleaning properties. Specifically, examples of the fluorine resin include polytetrafluoroethylene (hereinafter, PTFE), polychlorotrifluoroethylene (PCTFE), polyvinylidene fluoride (PVDF), polyvinyl fluoride (PVF), a perfluoroalkoxy fluorine resin (PFA), an ethylene tetrafluoride.propylene hexafluoride copolymer (FEP), an ethylene.ethylene tetrafluoride copolymer (ETFE), and an ethylene.chlorotrifluoroethylene copolymer (ECTFE). One or two or more types of such resins can be used, as necessary, and a plurality of films may be laminated in the first layer.

It is preferable that a pore diameter of the first layer on a side in contact with the image in the porous body, is less than or equal to 10 μm, from the viewpoint of suppressing the attachment of the color material at the time of being in pressure contact with the image. A film thickness of the first layer is preferably less than or equal to 50 μm, and is more preferably less than or equal to 30 μm. In this example, the film thickness is obtained by measuring film thicknesses of arbitrary 10 points, and by calculating an average value thereof, by using a direct advance type micrometer OMV_25 (manufactured by Mitutoyo Corporation).

(1-7-5-2) Second Layer

It is preferable that the second layer has air permeability, and for example, may be an unwoven cloth or a woven cloth. A forming material of the second layer is not particularly limited. For example, a single material such as polyolefin (polyethylene (PE), polypropylene (PP), and the like), polyurethane, nylon, polyamide, polyester (polyethylene terephthalate (PET) and the like), and polysulfone (PSF), or a composite material thereof, and the like are preferable.

(1-7-5-3) Third Layer

The porous body may be configured of three or more layers including the third layer, and the number of laminations is not limited. An unwoven cloth is preferable as the third layer from the viewpoint of rigidity. In addition, the same material as that of the second layer can be used as a forming material of the third layer.

(1-7-5-4) Manufacturing Method of Porous Body

A method of forming the porous body by laminating the first layer and the second layer is not particularly limited, and for example, the first layer and the second layer may be only superimposed, or may adhere to each other by a method of adhesive agent lamination, thermal lamination, or the like. The adhesion according to the thermal lamination is preferable from the viewpoint of the air permeability. In addition, a part of the first layer or the second layer may be melted by being heated, and thus, the first layer and the second layer may be laminated by adhering to each other. In addition, a fusion material such as a hot melt powder may be interposed between the first layer and the second layer, and the fusion material may be heated, and thus, the first layer and the second layer may be laminated by adhering to each other. In the case of laminating a layer including the third layer, such layers may be laminated at one time, or such layers may be sequentially laminated, and a lamination order of such layers can be suitably selected. In a heating step, it is preferable to use a laminating method in which the porous body is interposed between by heated rollers, and the porous body is heated while being pressurized.

(1-8) Radiation Heating Unit

The ink image on the intermediate transfer body 1 is heated by radiation heat from the radiation heating unit 10, and the solid content in the ink image is softened, and thus, a film is formed. At this time, the image is heated to a glass transition temperature Tg of a film forming component such as resin fine particles, and thus, the resin fine particles or the like are formed into a film on the intermediate transfer body 1, and the film is transferred to the printing medium 8 having a low temperature.

Tg of the resin is measured on the basis of ASTM D3418-82 by using a differential scanning calorimetry analyzer "Q2000" (manufactured by TA Instruments Inc.). In temperature correction of an apparatus detection unit, a melting point of indium and zinc is used, and in correction of heat quantity, melting heat of indium is used. Specifically, approximately 2 mg of a sample is accurately weighed, and the sample is put into an aluminum pan, and measurement is performed at a temperature increasing rate of 10° C./min in a measurement temperature range of 30° C. to 200° C. by using a vacant aluminum pan as a reference. Furthermore, in the measurement, temperature increasing is performed up to 200° C. at one time, and then, temperature decreasing is performed up to 30° C., and after that, temperature increasing is performed again. In a temperature range of 40° C. to 100° C. of the second temperature increasing process, a specific heat change is obtained. At this time, an intersection point between a line of an intermediate point of a baseline before and after the specific heat change occurs, and a differential thermal curve, is set to the glass transition temperature Tg of the resin.

In this example, the ink is dried at an ordinary temperature by using such an apparatus, and then, the glass transition temperature Tg is evaluated.

Various lamps can be used as a radiation heating source of the radiation heating unit 10, and for example, an infrared ray heater such as a halogen lamp has a high heating efficiency, and thus, is preferable. Further, in order to efficiently guide radiation heat to the intermediate transfer body 1, it is preferable to use a reflective mirror (a reflection portion). In order to obtain an image having excellent toughness, it is important to set a temperature of transferring the image with respect to the printing medium 8 to be higher than or equal to Tg of the resin fine particle component forming the image. In the transfer of the image with respect to the printing medium 8 at the temperature of higher than or equal to Tg, the temperature is preferably higher than or equal to 10° C., and is more preferably higher than or equal to 25° C., from Tg, from the viewpoint of the transfer properties and the toughness of the image. In the following description, such a preferred temperature will be referred to as a lowermost film forming temperature. Furthermore, in this example, the lowermost film temperature is set to Tg+25° C. However, the lowermost film temperature may be higher than or equal to Tg, or may be a temperature according to the transfer properties and the image toughness necessary at each time.

The radiation heating unit 10 of this example has a configuration in which a plurality of radiation heating sources including a halogen lamp and a reflective mirror as a pair, are arranged in a rotation direction of the intermediate transfer body 1. A product manufactured by Finetech Co., Ltd. is used as the halogen lamp and the reflective mirror. Maximum output of the halogen lamp is $12\times10^3$ W/m, and an AL paraboloidal mirror of which the surface is subjected to mirror surface grinding is used as the reflective mirror. The halogen lamp and the reflective mirror are slightly longer than the overall width of the intermediate transfer body 1 (in FIG. 1, a front-rear direction of a paper surface) such that the overall width of the intermediate transfer body 1 can be heated. A plurality of halogen lamps are connected to a power source (not illustrated), and power is individually supplied to each of the lamps.

(1-9) Transfer Unit

The transfer unit 6 brings the intermediate transfer body 1 into pressure contact with the printing medium 8 which is transported by the transport unit 7, and transfers the image on the intermediate transfer body 1 to the printing medium 8. As described above, the liquid component contained in the image on the intermediate transfer body 1 is removed, and then, the image is heated to a temperature higher than or equal to the lowermost film forming temperature, and is transferred to the printing medium 8. Accordingly, it is possible to ensure film formability and adhesiveness with respect to the printing medium 8, and to obtain a printing image in which curling, cockling, or the like of the printing medium 8 is suppressed. For example, the transfer unit 6 has a configuration using a pressurizing roller.

In the transfer unit 6, a certain degree of structure strength is demanded, from the viewpoint of the transport accuracy and the durability of the printing medium 8. A metal, ceramic, a resin, and the like are preferably used as a material of a configuration member of the transfer unit 6 (a pressurizing roller or the like). In particular, in order to improve the control responsiveness by reducing the inertia at the time of the operation, in addition to the rigidity against pressurization at the time of transfer, and the dimensional accuracy, aluminum, iron, stainless steel, an acetal resin, an epoxy resin, polyimide, polyethylene, polyethylene terephthalate, nylon, polyurethane, silica ceramics, and alumina ceramics are preferably used. In addition, such materials may be used by being combined.

Time for bringing the image on the intermediate transfer body 1 into pressure contact with the printing medium 8 is not particularly limited. In order to perform excellent transfer, and not to impair the durability of the intermediate transfer body 1, it is preferable that the time is longer than or equal to 5 ms and shorter than or equal to 100 ms. The time for allowing the image on the intermediate transfer body 1 into pressure contact with the printing medium 8 is time for which the intermediate transfer body 1 is in contact with the printing medium 8. In this example, a surface pressure is measured by using a surface pressure distribution meter (I-SCAN, manufactured by NITTA Corporation), and the pressure is calculated by dividing a length of a pressurized region in a transport direction by a transport rate.

A pressure for bringing the image on the intermediate transfer body 1 into pressure contact with the printing medium 8 is not particularly limited. In order to perform excellent transfer, and not to impair the durability of the intermediate transfer body 1, it is preferable that the pressure is greater than or equal to 1 kg/cm$^2$ and less than or equal to 30 kg/cm$^2$. The pressure corresponds to a nip pressure between the printing medium 8 and the intermediate transfer body 1, a surface pressure is measured by using a surface pressure distribution meter, and the pressure is calculated by dividing a load in a pressurized region by an area.

A temperature for allowing the image on the intermediate transfer body 1 into pressure contact with the printing medium 8 is not particularly limited. It is preferable to provide a heating unit for heating the image on the intermediate transfer body 1, the intermediate transfer body 1, and the printing medium 8. In addition, the shape of the transfer unit 6 is not particularly limited, and for example, the transfer unit 6 may be in the shape of a roller.

(1-10) Transport Unit of Printing Medium and Printing Medium

The printing medium 8 is not particularly limited, and a known printing medium can be used. Examples of the printing medium 8 include a roll-like medium and a sheet-like medium. Examples of a material of the printing medium 8 include paper, a plastic film, a wooden board, a cardboard, a metal film, and the like.

The transport unit 7 transporting the printing medium 8 includes a feeding roller 7*a* feeding the printing medium 8, and a winding roller 7*b* winding the printing medium 8. However, the transport unit 7 is not limited to the configuration of this example, insofar as being capable of transporting the printing medium 8.

(1-11) Control Unit

Figure 2:
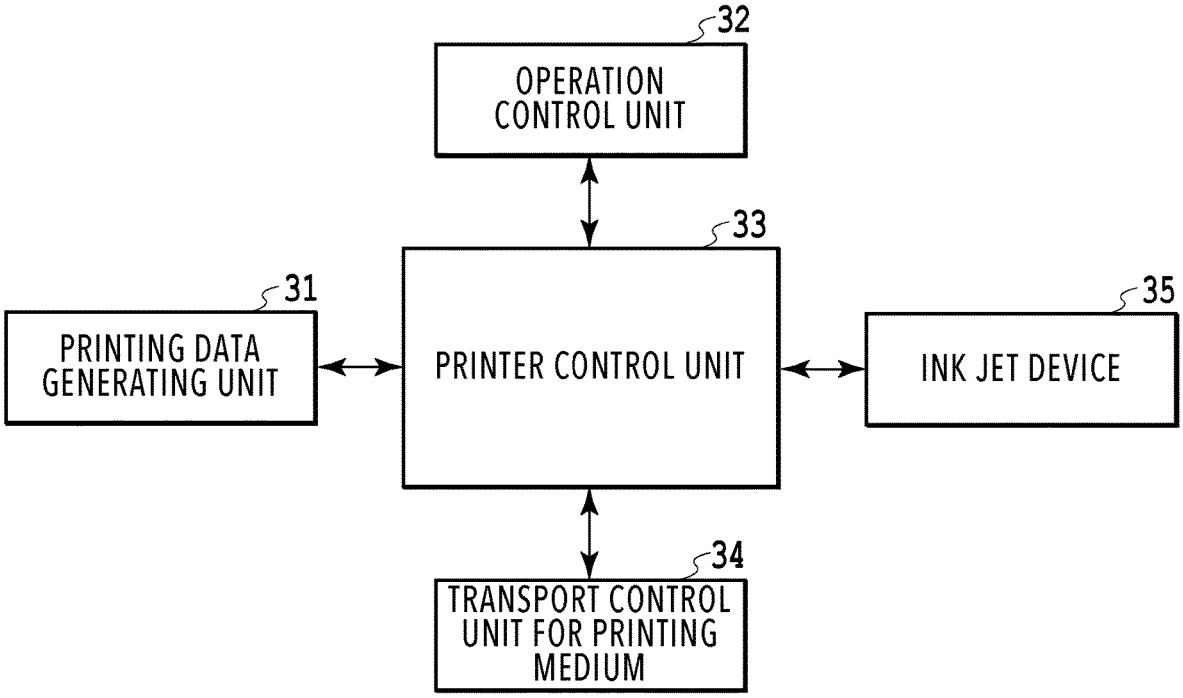
FIG. 2 is a block diagram of a control system of the image forming apparatus of FIG. 1.

The transfer type ink jet printing apparatus of this example includes a control unit for controlling each of the units described above. FIG. 2 is a block diagram of a control system of the entire apparatus in the transfer type ink jet printing apparatus of FIG. 1. In FIG. 2, a printing data generating unit 31 is an external server or the like, and generates printing data. An operation control unit 32 is configured of an operation panel or the like. A printing process is performed by a printer control unit 33, the printing medium is transported by a transport control unit 34, and the image is formed by an ink jet device 35.

Figure 3:
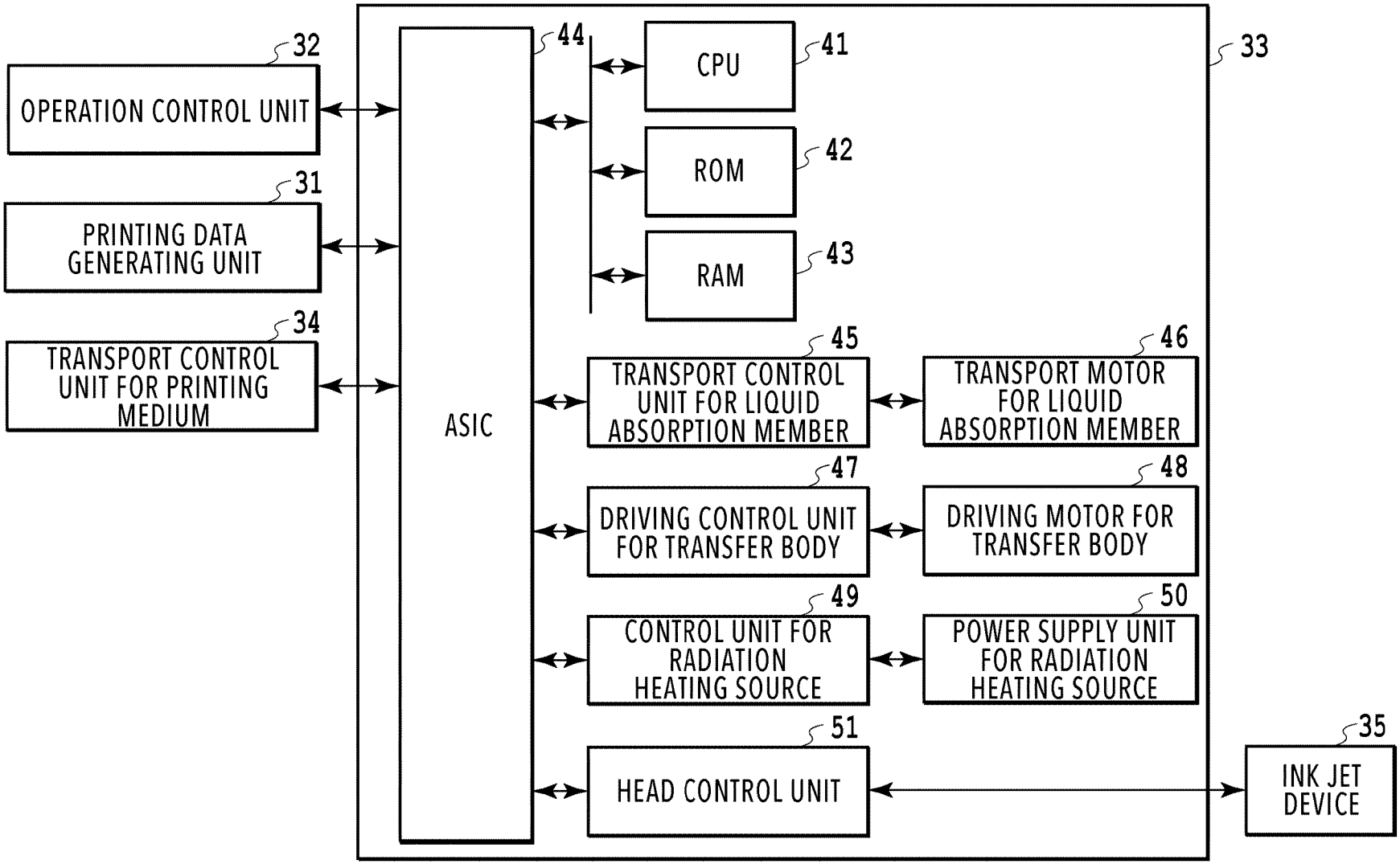
FIG. 3 is a block diagram of a printer control unit of FIG. 2.

FIG. 3 is a block diagram of the printer control unit 33. A CPU 41 is used for controlling the entire printer, a ROM 42 is used for storing a control program of the CPU 41, and a RAM 43 is used for executing the program. A network controller, a serial IF controller, a controller for generating head data, a motor controller, and the like are embedded in an ASIC 44. A transport control unit 45 driving a transport motor 46 for a liquid absorption member is subjected to command control by the ASIC 44 through a serial IF. A driving control unit 47 driving a driving motor 48 for an intermediate transfer body is command controlled by the ASIC 44 through the serial IF. A control unit 49 driving a power supply unit 50 for a radiation heating source is subjected to command control by the ASIC 44 through the serial IF. The control unit 49 and the power supply unit 50 are included in a control unit configured to be capable of individually controlling the degree of heating the intermediate transfer body by the plurality of heating sources. Such a control unit including the control unit 49 and the power supply unit 50 is capable of individually controlling supply power with respect to the plurality of heating sources. A head control unit 51 generates final ejection data for the ink jet device 35, and generates a driving voltage.

(2) First Embodiment

In a first embodiment, the transfer type ink jet printing apparatus as illustrated in FIG. 1 is used. In this example, the intermediate transfer body 1 is fixed to the support member 2 by an adhesive agent.

In this example, a sheet in which a silicone rubber (KE12, manufactured by Shin-Etsu Chemical Co., Ltd.) is applied onto a PET sheet having a thickness of 0.5 mm to have a thickness of 0.3 mm, is used as the elastic layer of the intermediate transfer body 1. Foamable silicone rubber of a thickness of 0.5 mm including air bubbles is provided on a lower layer of the elastic layer, as a heat-insulating layer between the elastic layer and the support member 2. Further, a mixture of a condensate obtained by mixing glycidoxypropyl triethoxy silane and methyl triethoxy silane at a molar ratio of 1:1, and by being subjected to heating reflux, and an optical cation polymerization initiator (SP150, manufactured by ADEKA CORPORATION) is prepared. The mixture is supplied onto the elastic layer while the elastic layer is subjected to an atmospheric pressure plasma treatment, such that a contact angle of water on the surface of the elastic layer is less than or equal to 10 degrees. The mixture on the elastic layer is subjected to film formation by UV irradiation (a high-pressure mercury lamp, and an integrated exposure amount of 5000 mJ/cm$^2$) and thermal curing (at 150° C. for 2 hours), and thus, the intermediate transfer body 1 is prepared in which the surface layer having a thickness of 0.5 μm is formed on the elastic body.

In this example, a double-faced tape (not illustrated) for retaining the intermediate transfer body 1 between the intermediate transfer body 1 and the support member 2 is provided. A double-faced tape (not illustrated) for retaining the elastic layer is provided between the elastic layer and the heat-insulating layer of the intermediate transfer body 1.

A reaction liquid having the following compositions is used as the reaction liquid supplied by the reaction liquid supplying unit 3, and a supply amount thereof is 1 g/m$^2$.

| | |
|---|---|
| Glutaric Acid | 21.0 parts |
| Glycerin | 5.0 parts |
| Surfactant (Product Name: Megaface F444, manufactured by DIC Corporation) | 5.0 parts |
| Ion Exchange Water | remnant |

In this example, the ink is prepared as follows.

(2-1) Preparation of Pigment Dispersion Element

Ten parts of carbon black (Product Name: MONARCH 1100, manufactured by Cabot Corporation), 15 parts of a resin aqueous solution (an aqueous solution having a content of a resin (a styrene-ethyl acrylate-acrylic acid copolymer having an acid value of 150, and a weight average molecular weight (Mw) of 8,000) of 20.0% mass is neutralized with a potassium hydroxide aqueous solution), and 75 parts of pure water are mixed. The mixture is put into a batch type vertical sand mill (manufactured by AIMEX CO., Ltd.), and is filled with 200parts zirconia beads having a diameter of 0.3 mm, and a dispersion treatment is performed for 5hours while performing water cooling. The dispersion liquid is subjected to centrifugal separation, coarse particles are removed, and then, a black pigment dispersion element having a content of a pigment of 10.0% mass is obtained.

(2-2) Preparation of Resin Particle Dispersion Element

Twenty parts of ethyl methacrylate, 3 parts of 2,2'-azobis-(2-methyl butyronitrile), and 2 parts of n-heptadecane are mixed, and are stirred for 0.5 hours. The mixture is dropped into 75 parts of an aqueous solution of 8% of a styrene-butyl acrylate-acrylic acid copolymer (Acid Value: 130 mgKOH/g, Weight Average Molecular Weight (Mw): 7,000), and is stirred for 0.5 hours. Next, the stirred material is irradiated with an ultrasonic wave by an ultrasonic wave irradiation machine for 3 hours, and then, a polymerization reaction is performed at 80° C. for 4hours under a nitrogen atmosphere. Then, filtration is performed after cooling at a room temperature, and thus, a resin particle dispersion element having a content of a resin of 25.0% mass is prepared.

(2-3) Preparation of Ink

The resin particle dispersion element and the pigment dispersion element are mixed with the following component. In the remnant of the ion exchange water, the sum of all components configuring the ink is 100.0% mass.

| | |
|---|---|
| Pigment Dispersion Element (Content of Color Material: 10.0% mass ) | 40.0% mass |
| Resin Particle Dispersion Element | 20.0% mass |
| Glycerin | 7.0% mass |
| Polyethylene Glycol (Number Average Molecular Weight (Mn): 1,000) | 3.0% mass |
| Surfactant: Acetylenol E100 (manufactured by Kawaken Fine Chemicals Co., Ltd) | 0.5% mass |
| Ion Exchange Water | remnant |

Such a mixture is sufficiently stirred and dispersed, and then, pressure filtration is performed by using a microfilter (manufactured by FUJIFILM Corporation) having a pore size of 3.0 μm, and thus, a black ink is prepared.

In the ink supplying unit 4, an ink jet head ejecting the ink by an on-demand system using an electrothermal conversion element is used as the ejection energy generating element, and an ink supply amount is 20 g/m$^2$. In addition, a transport rate of the liquid absorption member 5*a* is adjusted to the same rate as the movement rate of the intermediate transfer body 1 by the transport rollers 5*c*, 5*d*, and 5*e* transporting the liquid absorption member 5*a* while stretching the liquid absorption member 5*a*. In addition, the printing medium 8 is transported by the feeding roller 7*a* and the winding roller 7*b* such that a transport rate is identical to the movement rate of the intermediate transfer body 1. In this example, the transport rate is 0.4 m/s, and Aurora coat paper (manufactured by Nippon Paper Industries Co., Ltd., a basis weight of 104 g/m$^2$) is used as the printing medium 8. In addition, a pressure is supplied to the liquid absorption member 5*a* such that an average pressure of the nip pressures between the intermediate transfer body 1 and the liquid absorption member 5*a* is 2 kg/cm$^2$. In addition, a roller having a diameter of 200 mm is used as the pressing member 5*b* of the liquid absorption unit 5.

(2-4) Radiation Heating Unit

The radiation heating unit 10 of this example has a configuration in which a plurality of radiation heating sources including a halogen lamp and a reflective mirror as a pair are arranged to be shifted in the rotation direction of the intermediate transfer body 1. A product manufactured by Finetech Co., Ltd. is used as the halogen lamp and the reflective mirror. Maximum output of the halogen lamp is 12×10$^3$ W/m, and an AL paraboloidal mirror of which the surface is subjected to mirror surface grinding is used as the reflective mirror. The halogen lamp and the reflective mirror are slightly longer than the overall width of the intermediate transfer body 1 (in FIG. 1, the front-rear direction of the paper surface), such that the overall width of the intermediate transfer body 1 can be heated. A plurality of halogen lamps are connected to a power source (not illustrated), and power is individually supplied to each of the lamps.

(2-5) Heating Temperature Evaluation

In order to evaluate a heating state of the intermediate transfer body by the radiation heating source, a ray-trace simulation for estimating an illumination distribution from the radiation heating source, and a heat conduction simulation for estimating a temperature at the time of receiving radiation heat, are performed.

The ray-trace simulation is performed by two-dimensional calculation on a sectional surface with respect to a width direction of the intermediate transfer body (in FIG. 1, the front-rear direction of the paper surface), and in consideration of each shape and the arrangement of the halogen lamp, the reflective mirror, and the intermediate transfer body, a radiation illumination distribution on the intermediate transfer body is calculated. The halogen lamp is configured of a tungsten strand having a diameter of approximately 2 mm, and a glass tube having a diameter of approximately 10 mm which encompasses the tungsten strand. A part of radiation energy emitted from the tungsten strand is transmitted through the glass tube, and proceeds towards a heated body and the reflective mirror. In the light from the tungsten strand, light absorbed in the glass tube is spent in order to heat the glass tube itself, and is converted into light emitted from the heated glass tube. Therefore, in consideration of the shape and a reflection rate of the reflective mirror, a locus of the light emitted from the tungsten strand and the glass tube can be calculated, and in consideration of radiation energy applied to the heated body and an absorption rate of the radiation energy of the heated body, a degree of heating the heated body can be calculated. An infrared ray reflection rate of the AL reflective mirror used in this example is 98%, and an infrared ray absorption rate of the intermediate transfer body which is the heated body is 85%.

The heat conduction simulation is performed by one-dimensional calculation in a thickness direction of the intermediate transfer body 1, in a coordination system on the surface of the rotating intermediate transfer body 1. A temperature change at a certain point of the intermediate transfer body 1 receiving radiation heat while rotating is calculated by using the result of the ray-trace simulation.

Figure 4:
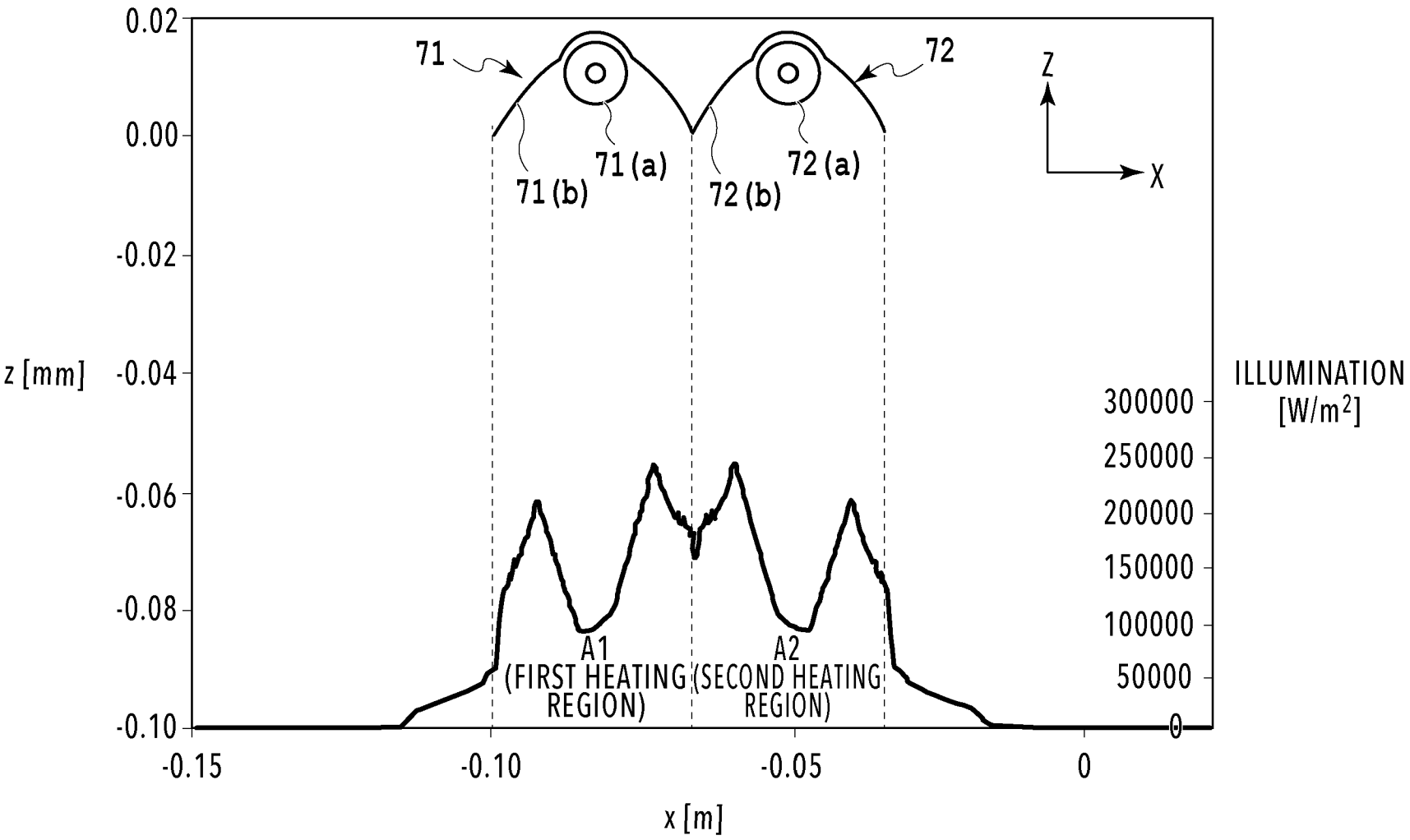
FIG. 4 is an explanatory diagram of a relationship between a radiation heating unit and an illumination distribution in a first embodiment of the invention.

FIG. 4 is an explanatory diagram of a result obtained by calculating an illumination distribution applied to the intermediate transfer body 1 from two radiation heating sources 71 and 72 according to the ray-trace simulation, and also illustrates spatial arrangement of the radiation heating sources 71 and 72. In actuality, the plurality of radiation heating sources are arranged along the rotation direction of the cylindrical intermediate transfer body 1. However, two adjacent radiation heating sources in the rotation direction of the intermediate transfer body 1 are in a relationship of being relatively and linearly arranged, and thus, in FIG. 4, the surface of the intermediate transfer body 1 is linearly laid out. In FIG. 4, an arrow X represents the rotating direction of the intermediate transfer body 1, and an arrow Z represents a direction extending radially and outward from the surface of the intermediate transfer body 1. The radiation heating source 71 is positioned on an upstream side in the rotation direction of the intermediate transfer body 1 from the radiation heating source 72. Each of the radiation heating sources 71 and 72 includes halogen lamps 71(*a*) and 72(*a*), and reflective mirrors 71(*b*) and 72(*b*). FIG. 4 is a calculation result of the irradiation distribution in a case where two halogen lamps 71(*a*) and 72(*a*) are operated at the maximum input power of 100% ($12\times10^3$ W/m), and the illumination distributions from two radiation heating sources 71 and 72 are superimposed. In this example, a region immediately below the reflective mirrors 71(*b*) and 72(*b*) is a heating region, a heating region on the upstream side in the rotation direction of the intermediate transfer body 1 is a first heating region A1, and a heating region on a downstream side in the rotation direction of the intermediate transfer body 1 is a second heating region A2.

Figure 5:
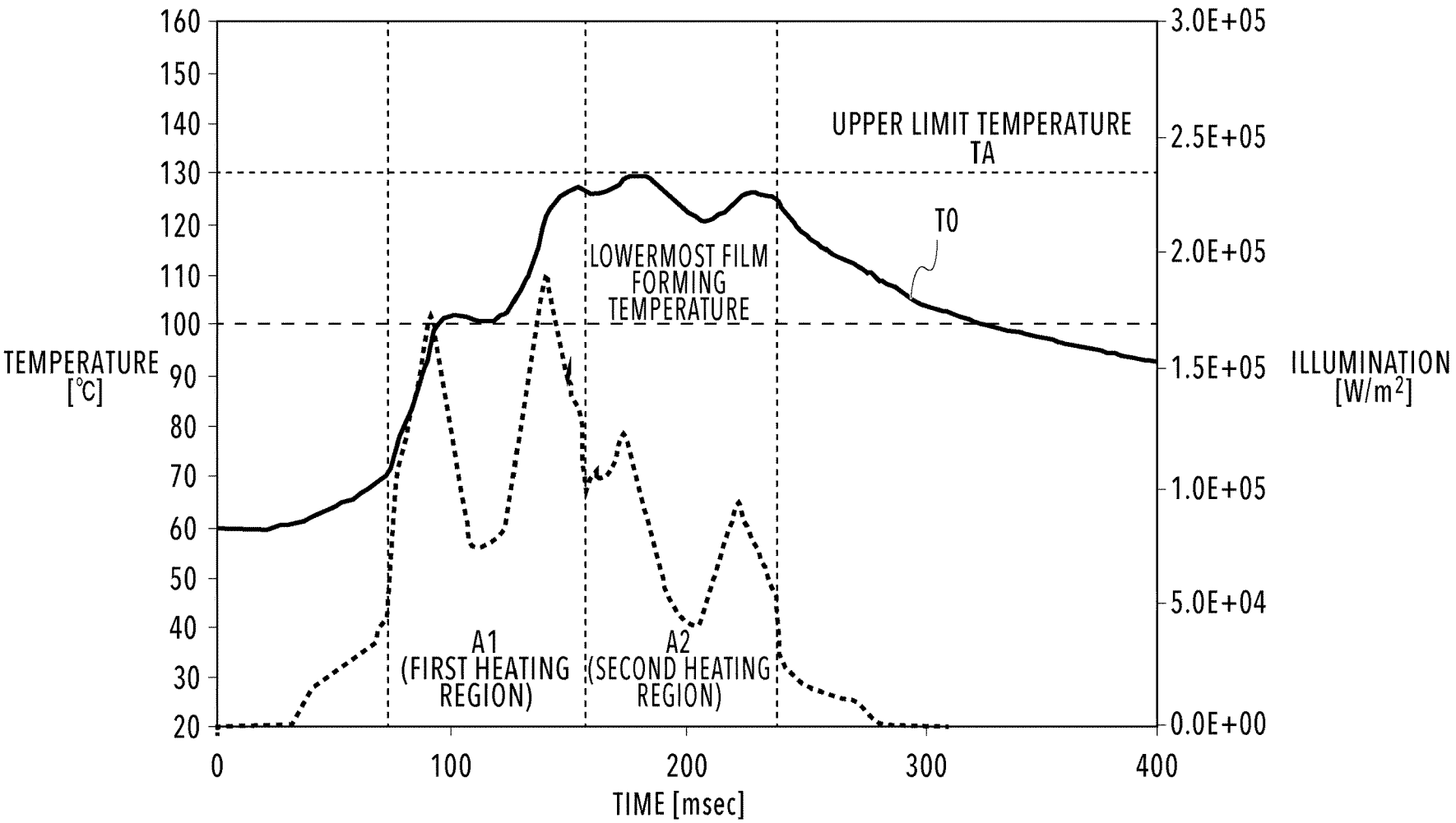
FIG. 5 is an explanatory diagram of a relationship between a surface temperature and the illumination distribution of an intermediate transfer body in the first embodiment of the invention.

FIG. 5 is an explanatory diagram of a result obtained by calculating transition of a surface temperature T0 of the intermediate transfer body 1 according to the heat conduction simulation, by using a calculation result of the illumination distribution of FIG. 4. In FIG. 5, a horizontal axis indicates time, a vertical axis on a left side indicates a surface temperature of the intermediate transfer body 1, and a vertical axis on a right side indicates an illumination applied to the intermediate transfer body 1 from the radiation heating sources 71 and 72. Power having a ratio of R1 with respect to the maximum input power is input into the halogen lamp 71(*a*), and power having a ratio of R2 with respect to the maximum input power is input into the halogen lamp 72(*a*). In this example, R1=84% and R2=46% are set. According to an operation condition of the halogen lamps 71(*a*) and 72(*a*), as illustrated in FIG. 5, the surface temperature T0 of the intermediate transfer body 1 rapidly increases to approximately 130° C., and then, is retained at approximately 130° C. In such an operation condition, the halogen lamp 71(*a*) heats the intermediate transfer body 1 with a heating degree higher than a heating degree of the halogen lamp 72(*a*) with which the intermediate transfer body 1 is heated, as stated above.

When the intermediate transfer body 1 is subjected to radiation heating, the reaction liquid containing an acid is applied onto the surface of the intermediate transfer body 1. For this reason, there is concern that the surface layer of the intermediate transfer body 1 is affected due to the acid of the reaction liquid, as a heating temperature with respect to the intermediate transfer body 1 becomes higher, and heating time becomes longer. In particular, a chemical reaction rate is exponentially accelerated according to an increase in the temperature. For this reason, in order to suppress the damage on the surface of the intermediate transfer body 1 due to the acid of the reaction liquid, temperature management is important in which the surface temperature T0 of the intermediate transfer body 1 is suppressed to be lower than or equal to a predetermined upper limit temperature TA.

General heating time of the radiation heating source is several hundred msec, and it is ensured that there is no problem of durability in the intermediate transfer body coated with the reaction liquid containing the acid insofar as a heating condition is a temperature of lower than or equal to 130° C. For this reason, in this example, the upper limit temperature TA is 130° C., and the intermediate transfer body is heated within a range not exceeding the upper limit temperature TA. A portion of the intermediate transfer body to which the ink is supplied, is heated to the lowermost film forming temperature by a first radiation heating source initially heating the portion (in the rotation direction of the intermediate transfer body, a heating source positioned on the most upstream side). For this reason, it is possible to efficiently form the film of the ink from the time of heating of the first radiation heating source. In addition, in this example, the intermediate transfer body is heated to a temperature of higher than or equal to 20° C. from the lowermost film forming temperature, and thus, film formability and transfer properties of the ink can be ensured.

Thus, it is important that transition is performed in a state where the film formation of the ink can be accelerated by heating the first heating region A1 to a temperature of higher than or equal to the lowermost film forming temperature while suppressing the surface temperature T0 of the intermediate transfer body to be lower than or equal to the upper limit temperature TA over the entire heating region, and then, the temperature is maintained to a temperature close to the upper limit temperature TA. The upper limit temperature TA has a relationship with the type of acid contained in the reaction liquid, a material and a preparing method of the surface of the intermediate transfer body, and a durability condition required as the image forming apparatus, and thus, may be set according to such conditions.

In this example, the temperature of the intermediate transfer body according to the radiation heating is evaluated by using the ray-trace simulation and the heat conduction simulation. However, the evaluation can be performed on the basis of actual measurement. For example, a temperature sensor such as a thermoelectric couple, which is heated by the radiation heating source along with the intermediate transfer body, may be used, and the temperature of the intermediate transfer body may be evaluated on the basis of a detection temperature of the temperature sensor. In this case, it is desirable that a temperature measuring unit of the thermoelectric couple is subjected to a blackbody treatment of increasing a radiation heat absorption rate, and it is more preferable to use a strand having a small strand diameter, and a strand having small thermal capacity, such that a change in a radiation amount from the radiation heating source can be sensitively measured.

(3) Comparative Example 1

Figure 6:
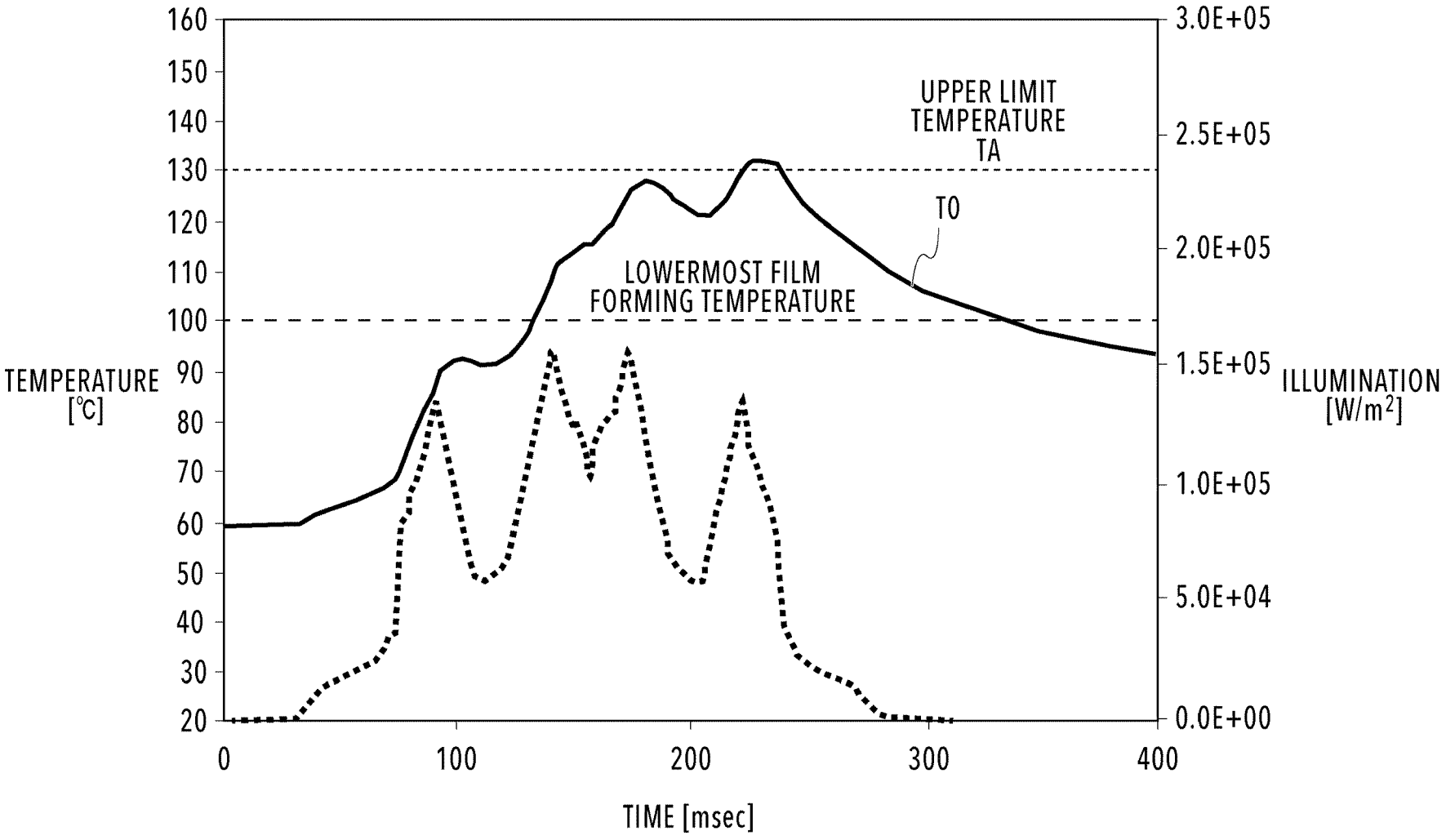
FIG. 6 is an explanatory diagram of a relationship between a surface temperature and an illumination distribution of an intermediate transfer body in Comparative Example 1.

FIG. 6 is an explanatory diagram of the surface temperature T0 and the illumination distribution of the intermediate transfer body in a case where each of the ratios R1 and R2 of the input power with respect to the halogen lamps 71(*a*) and 72(*a*) is 65% (R1=R2=65%), as Comparative Example 1. In the first embodiment of the invention described above, the ratio of the input power is R1=84% and R2=46%, the average thereof is 65%, and the sum thereof is 130%. In Comparative Example 1, the sum of the ratios R1 and R2 is 130% as with the first embodiment, and then, 130% is equally allocated to R1 and R2.

Thus, in Comparative Example 1, the input power with respect to the halogen lamps 71(*a*) and 72(*a*) is equally allocated by 65%. In this case, as illustrated in FIG. 6, the surface temperature T0 of the intermediate transfer body is lower than or equal to the upper limit temperature (130° C.) TA in the first half period, but is greater than the upper limit temperature TA in the later half period of several dozen msec. As a result of repeating a printing operation according to such a situation of exceeding the upper limit temperature TA, the surface layer of the intermediate transfer body becomes hard and brittle due to a reaction with an acid, and a crack is generated on the surface layer of the intermediate transfer body during a period not satisfying desired durability time. A crack is generated on the surface layer of the intermediate transfer body, and thus, an ink image is distorted, and desired image quality is not capable of being satisfied. In addition, the intermediate transfer body is not capable of being heated to a temperature of higher than or equal to the lowermost film forming temperature by the first radiation heating source initially heating the intermediate transfer body, and the film formation of the ink is started by a radiation heating source after the second radiation heating source. For this reason, ink film formability and image quality performance as with the first embodiment of the invention are not capable of being exhibited.

(4) Comparative Example 2

Figure 7:
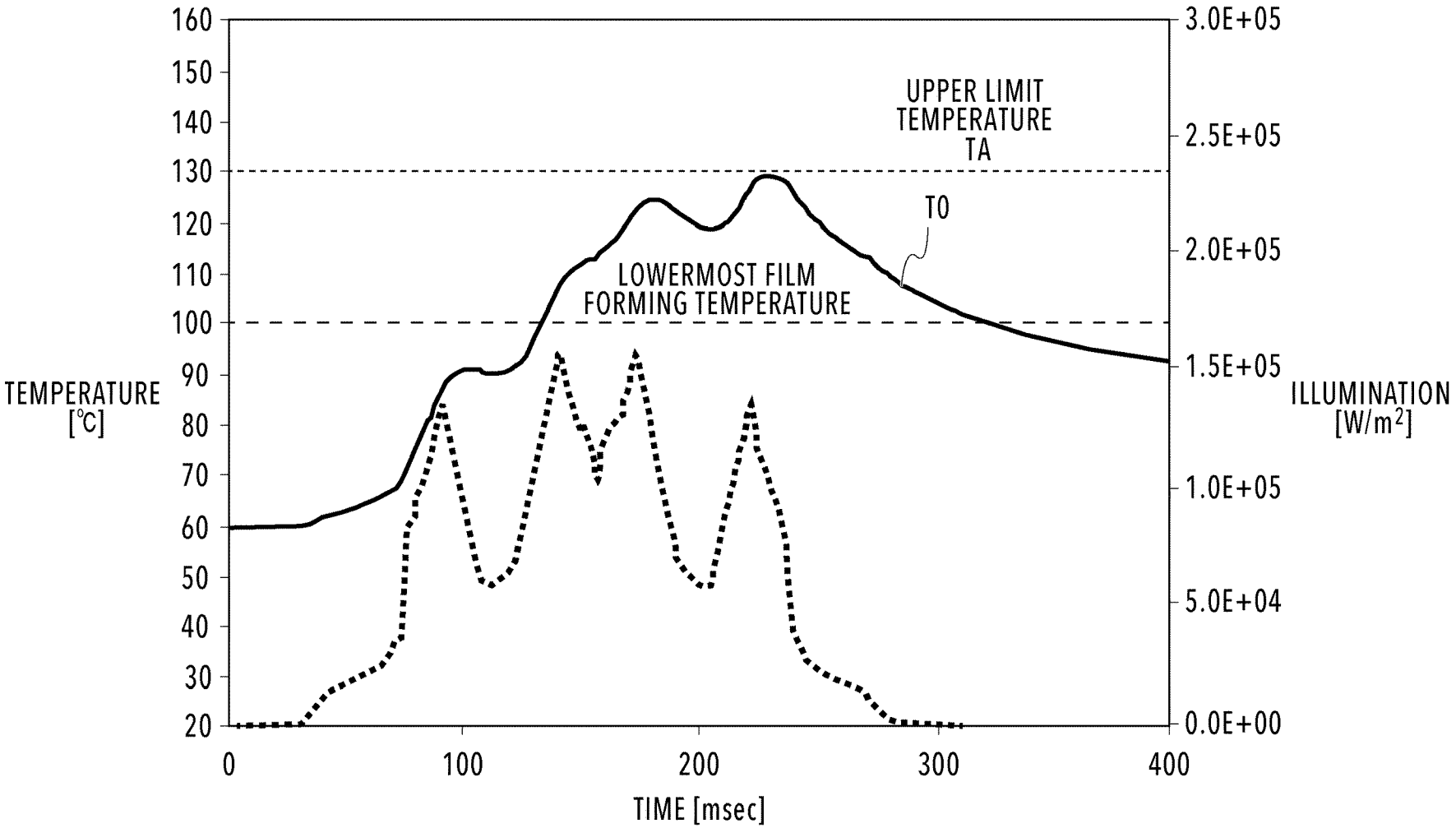
FIG. 7 is an explanatory diagram relationship between a surface temperature and an illumination distribution of an intermediate transfer body in Comparative Example 2.

FIG. 7 is an explanatory diagram of the surface temperature T0 and the illumination distribution intermediate transfer body in a case where the ratios R1 and R2 of the input power with respect to the halogen lamps 71(*a*) and 72(*a*) are 62% (R1=R2=62%), as Comparative Example 2. In Comparative Example 1 described above, as a result of equally setting 65% to the ratios R1 and R2 of the input power, the surface temperature T0 of the intermediate transfer body is greater than the upper limit temperature TA, and desired durability of the intermediate transfer body is not satisfied. In Comparative Example 2, the surface temperature T0 of the intermediate transfer body can be controlled such that the surface temperature T0 is lower than or equal to the upper limit temperature TA, and the durability is not degraded as with Comparative Example 1. However, as with Comparative Example 1, the intermediate transfer body is not capable of being heated to a temperature of higher than or equal to the lowermost film forming temperature by the first radiation heating source initially heating the intermediate transfer body, and the film formation of the ink is started by the radiation heating source after the second radiation heating source. For this reason, the ink film formability and the image quality performance as with the first embodiment of the invention are not capable of being exhibited.

As described above, in order to make the durability of the intermediate transfer body with respect to the acid, and the film formability of the ink image according to sufficient heating of the intermediate transfer body compatible, it is necessary to perform control such that the surface temperature T0 of the intermediate transfer body is set to a temperature of lower than or equal to the upper limit temperature TA and of higher than the lowermost film forming temperature. Therefore, in order to sufficiently exhibit such two performances, prompt heating and efficient heat retention are effective. In addition, in a case where the intermediate transfer body is heated a plurality of radiation heating sources, in order to promptly heat the surface of the intermediate transfer body to a target temperature, it is effective that a large heat quantity is applied by the radiation heating source positioned on the upstream side in the rotation direction of the intermediate transfer body. In addition, the radiation heat applied by the radiation heating source on the upstream side in the rotation direction of the intermediate transfer body is accumulated in the intermediate transfer body, and thus, in a case where comparable radiation heat is applied by the radiation heating source on the downstream side in the rotation direction of the intermediate transfer body, the surface temperature of the intermediate transfer body excessively increases. For this reason, in order to retain the temperature promptly increased by the radiation heating source on the upstream side to a predetermined temperature, it is necessary that the radiation heat applied by the radiation heating source on the downstream side is less than or equal to the radiation heat applied by the radiation heating source on the upstream side.

(5) Second Embodiment

As with the first embodiment described above, in this embodiment, the transfer type ink jet printing apparatus of FIG. 1 is used, and a basic configuration and an operation condition are identical to those of the first embodiment.

(5-1) Radiation Heating Unit

Figure 8:
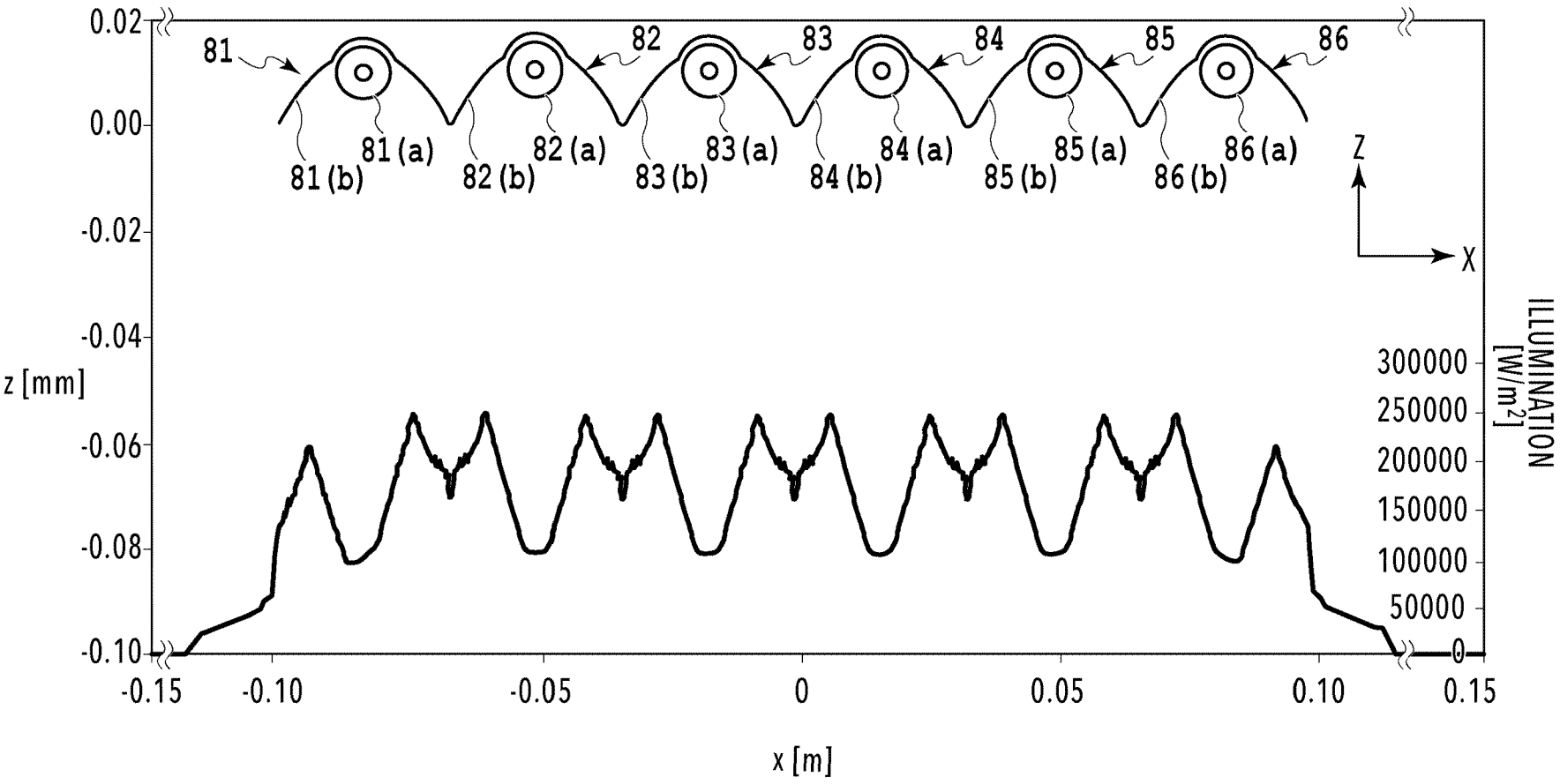
FIG. 8 is an explanatory diagram of a relationship between a radiation heating unit and an illumination distribution in a second embodiment of the invention.

As illustrated in FIG. 8, the radiation heating unit 10 of this embodiment has a configuration in which six radiation heating sources 81 to 86 including a halogen lamp and a reflective mirror as a pair, are arranged in the rotation direction of the intermediate transfer body 1. The halogen lamp and the reflective mirror are identical to those used in the first embodiment.

(5-2) Heating Temperature Evaluation

FIG. 8 is an explanatory diagram of a result obtained by calculating an illumination distribution applied to the intermediate transfer body 1 from six radiation heating sources 81 to 86 according to the ray-trace simulation, and also illustrates spatial arrangement of the radiation heating sources. In actuality, six radiation heating source are arranged along the cylindrical intermediate transfer body 1. However, two adjacent radiation heating source ends in the rotation direction of the intermediate transfer body 1 are in a relationship of being relatively and linearly arranged, and thus, in FIG. 8, the surface of the intermediate transfer body 1 is linearly laid out. In six radiation heating sources 81 to 86, the radiation heating source 81 is positioned on the most upstream side in the rotation direction of the intermediate transfer body 1, and the radiation heating source 86 is positioned on the most downstream side in the rotation direction. Each of six radiation heating sources 81 to 86 includes halogen lamps 81(*a*) to 86(*a*), and reflective mirrors 81(*b*) to 86(*b*). FIG. 8 is a calculation result of the irradiation distribution in a case where six halogen lamps 81(*a*) to 86(*a*) are operated at the maximum input power of 100% ($12\times10^3$ W/m), and the illumination distribution from six radiation heating sources are superimposed.

Figure 9:
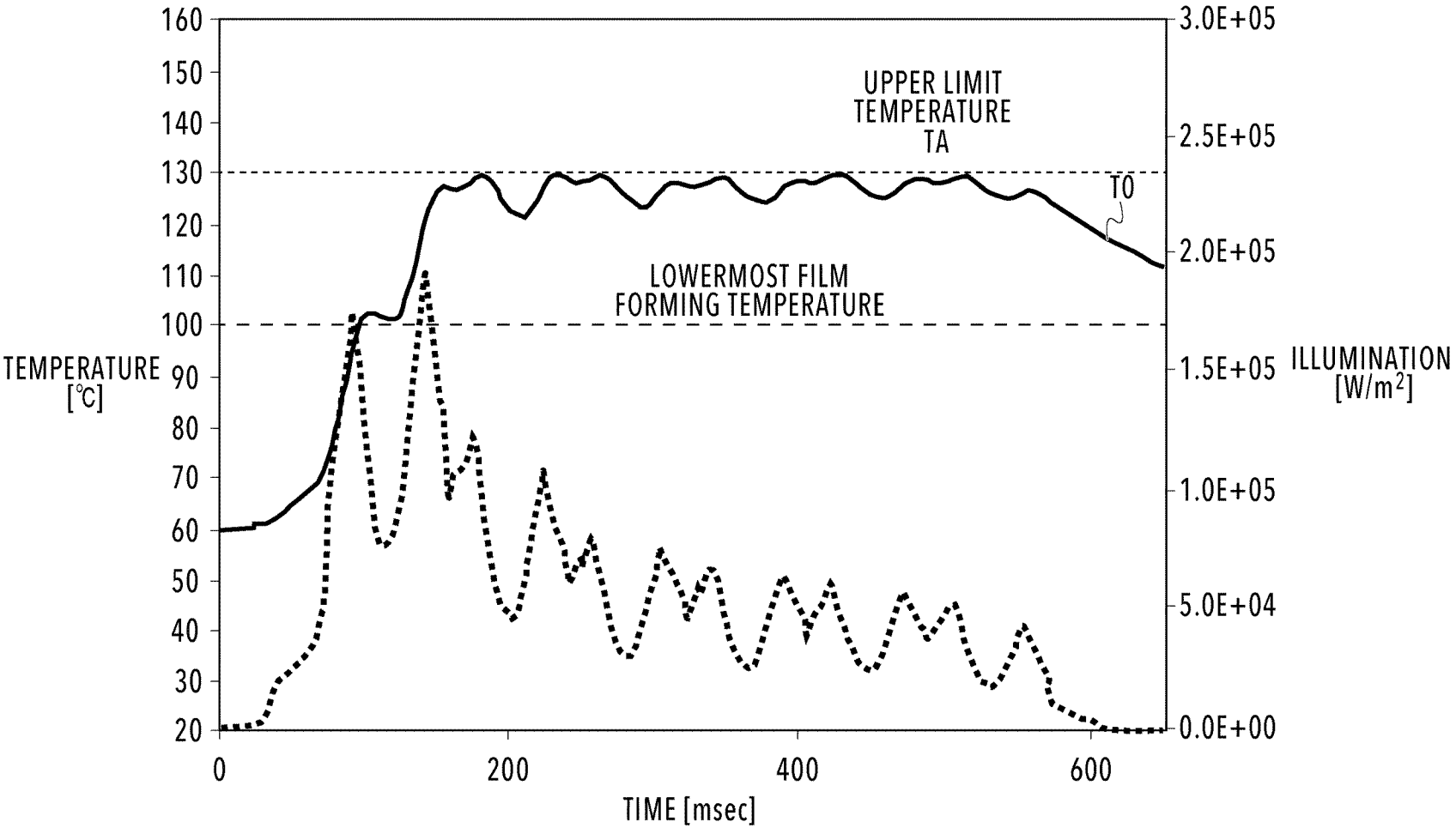
FIG. 9 is an explanatory diagram of a relationship between a surface temperature and the illumination distribution of an intermediate transfer body in the second embodiment of the invention.

FIG. 9 is an explanatory diagram of a result obtained by calculating the transition of the surface temperature T0 of the intermediate transfer body 1 according to the heat conduction simulation, by using a calculation result of the illumination distribution of FIG. 8. In FIG. 9, a horizontal axis indicates time, a vertical axis on a left side indicates the surface temperature T0 of the intermediate transfer body 1, and a vertical axis on a right side indicates an illumination applied to the intermediate transfer body 1 from the radiation heating source. Power having ratios of R1, R2, R3, R4, R5, and R6 with respect to the maximum input power is input to the halogen lamps 81(*a*) to 86(*a*). In this example, R1=84%, R2=46%, R3=32%, R4=28%, R5=25%, and R6=22% are set. Thus, by setting the supply power with respect to each of the radiation heating sources, the surface temperature T0 of the intermediate transfer body 1 is heated by the first radiation heating source 81(*a*) to a temperature of higher than or equal to the lowermost film forming temperature. Then, the surface temperature T0 rapidly increases to approximately the upper limit temperature TA of 130° C., and then, is retained at approximately 130° C.

(6) Comparative Example 3

Figure 10:
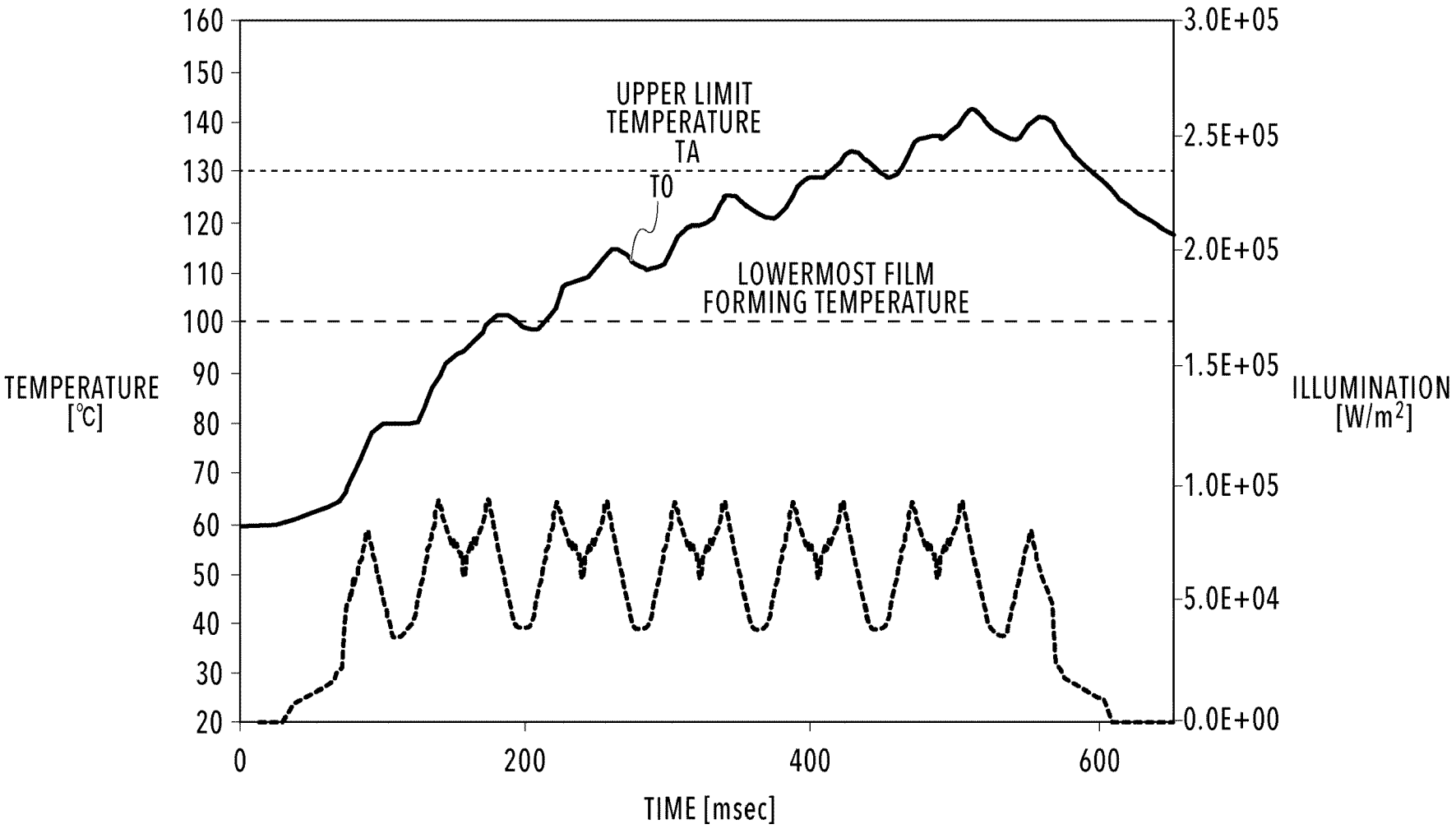
FIG. 10 is an explanatory diagram of a relationship between a surface temperature and an illumination distribution of an intermediate transfer body in Comparative Example 3.

FIG. 10 is an explanatory diagram of the surface temperature T0 and the illumination distribution of the intermediate transfer body in a case where all of the ratios R1 to R6 of the input power with respect to six halogen lamps 81(*a*) to 86(*a*) are 39.5% (R1=R2=R3=R4=R5=R6=39.5%), as Comparative Example 3. In the second embodiment of the invention, the ratio of the input power is R1=84%, R2=46%, R3=32%, R4=28%, R5=25%, R6=22%, the average thereof is 39.5%, and the sum thereof is 237%. In Comparative Example 3, the sum of the ratios R1 to R6 is 237% as with the second embodiment, and then, 237% is equally allocated to R1 to R6.

Thus, in Comparative Example 3, as illustrated in FIG. 10, power of 237% is equally allocated to R1 to R6. In this case, the surface temperature T0 of the intermediate transfer body is lower than or equal to the upper limit temperature (130° C.) TA in the first half period, but is greater than the upper limit temperature TA in the later half period of several dozen msec. As a result of repeating a printing operation according to such a situation of exceeding the upper limit temperature TA, the surface layer of the intermediate transfer body becomes hard and brittle due to a reaction with an acid, and a crack is generated on the surface layer of the intermediate transfer body during a period not satisfying desired durability time. A crack is generated on the surface layer of the intermediate transfer body, and thus, an ink image is distorted, and desired image quality is not capable of being satisfied. In addition, the intermediate transfer body is not capable of being heated to a temperature of higher than or equal to the lowermost film forming temperature by the first radiation heating source initially heating the intermediate transfer body, and the film formation of the ink is started by a radiation heating source after the second radiation heating source. For this reason, the ink film formability and the image quality performance as with the first embodiment of the invention are not capable of being exhibited.

(7) Comparative Example 4

Figure 11:
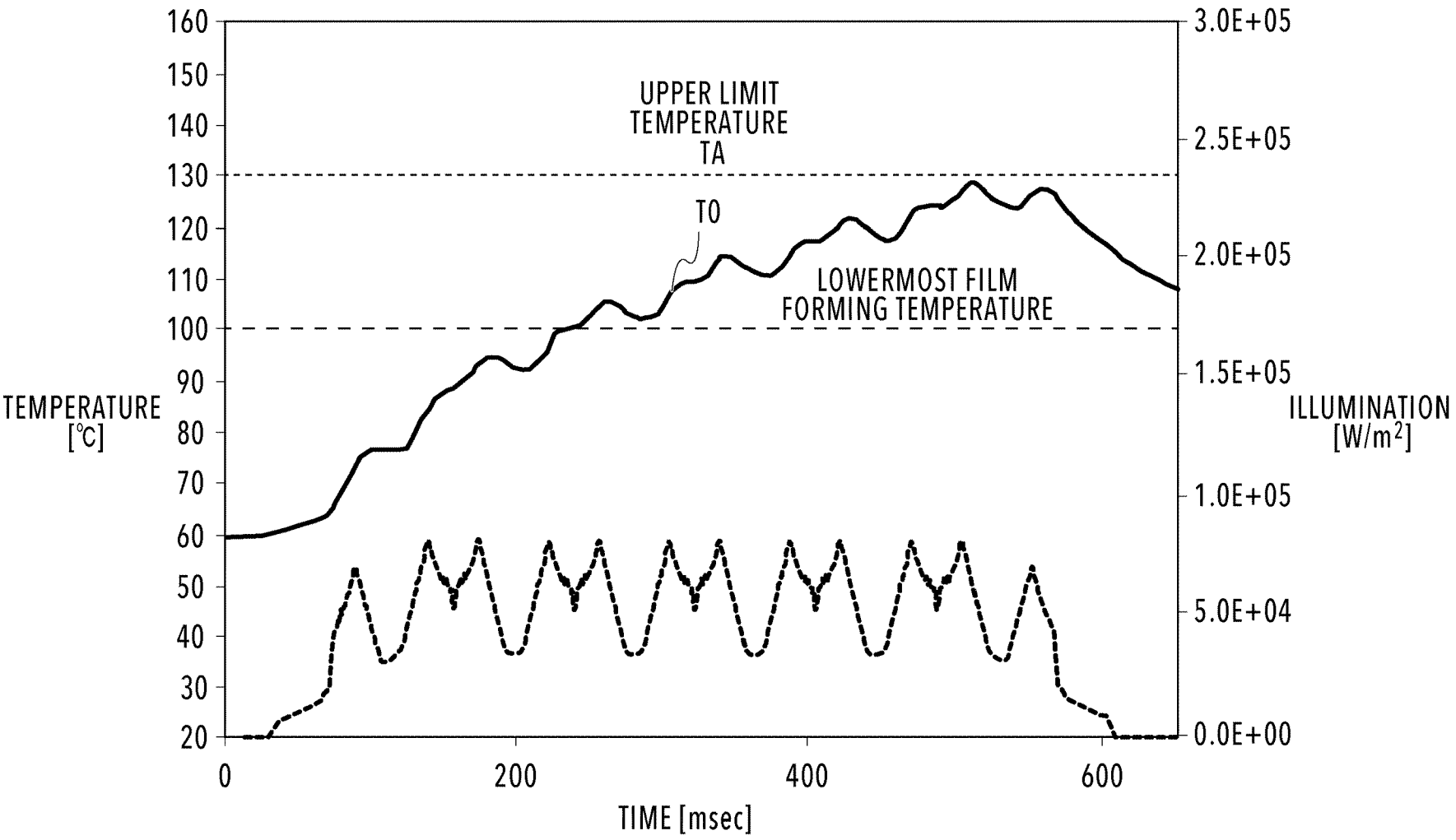
FIG. 11 is an explanatory diagram of a relationship between a surface temperature and an illumination distribution of an intermediate transfer body in Comparative Example 4.

FIG. 11 is an explanatory diagram of the surface temperature T0 and the illumination distribution of the intermediate transfer body in a case where all of the ratios R1 to R6 of the input power with respect to six halogen lamps 81(*a*) to 86(*a*) are 33% (R1=R2=R3=R4=R5=R6=33%), as Comparative Example 4. In Comparative Example 3 described above, as a result of equally setting 39.5% to the ratios R1 to R6 of the input power, the surface temperature T0 of the intermediate transfer body is greater than the upper limit temperature TA, and desired durability of the intermediate transfer body is not satisfied. In Comparative Example 4, the surface temperature T0 of the intermediate transfer body can be controlled such that the surface temperature T0 is lower than or equal to the upper limit temperature, and the durability is not degraded as with Comparative Example 3. However, as with Comparative Example 3, the intermediate transfer body is not capable of being heated to a temperature of higher than or equal to the lowermost film forming temperature by the first radiation heating source initially heating the intermediate transfer body, and the film formation of the ink is started by the radiation heating source after the second radiation heating source. For this reason, the ink film formability and the image quality performance as with the second embodiment of the invention are not capable of being exhibited.

(8) Third Embodiment

As with the first embodiment and the second embodiment described above, in this embodiment, the transfer type ink jet printing apparatus of FIG. 1 is used, and a basic configuration and an operation condition are identical to those of the second embodiment.

The intermediate transfer body 1 heated by the radiation heating unit 10 is contacted to the printing medium 8, the cleaning unit 9, the reaction liquid supplying unit 3, the liquid absorption member 5*a*, and the like, and thus, rotates while transferring heat therebetween. In consideration of the heat transfer, in a period from the reaction liquid supplying unit 3 to immediately before the radiation heating unit 10 during a continuous operation of the intermediate transfer body 1, the surface temperature of the intermediate transfer body 1 is designed to have an average temperature of approximately 60° C., such that the reaction liquid and the ink sufficiently react to each other. On the other hand, immediately after the printing apparatus is started up, and immediately after downtime of exchange, repair, or the like of an expendable item such as an ink, the surface temperature of the intermediate transfer body 1 decreases to approximately a room temperature. In order to ensure reactivity of the reaction liquid and the ink, it is necessary to increase the surface temperature of the intermediate transfer body up to 60° C. For this reason, before an image forming operation, a warming up operation of rotating the intermediate transfer body 1 while operating the radiation heating unit 10 is performed. At the time of the warming up, an image is not formed, and thus, it is not necessary to apply the reaction liquid onto the intermediate transfer body 1, unlike the case of the image forming operation, and heating can be performed to a temperature of higher than the upper limit temperature TA considering a chemical reaction between the acid in the reaction liquid and the intermediate transfer body 1. However, there is a heat resistance upper limit temperature TA(1) due to the material itself configuring the intermediate transfer body 1, and thus, it is necessary to perform the heating within a range of lower than or equal to the heat resistance upper limit temperature TA(1).

In this embodiment, the surface layer of the intermediate transfer body is thermally cured at a temperature of 150° C., and the intermediate transfer body is basically designed on the premise of being used at a temperature of lower than or equal to the thermal curing temperature 150° C. Accordingly, the heating of the intermediate transfer body at a temperature greater than the thermal curing temperature of 150° C. is not preferable since a condense state of the surface layer is changed, and thus, hardness of the film is changed. Therefore, in this embodiment, the heat resistance upper limit temperature TA(1) of the intermediate transfer body during the warming up is 150° C.

Figure 12:
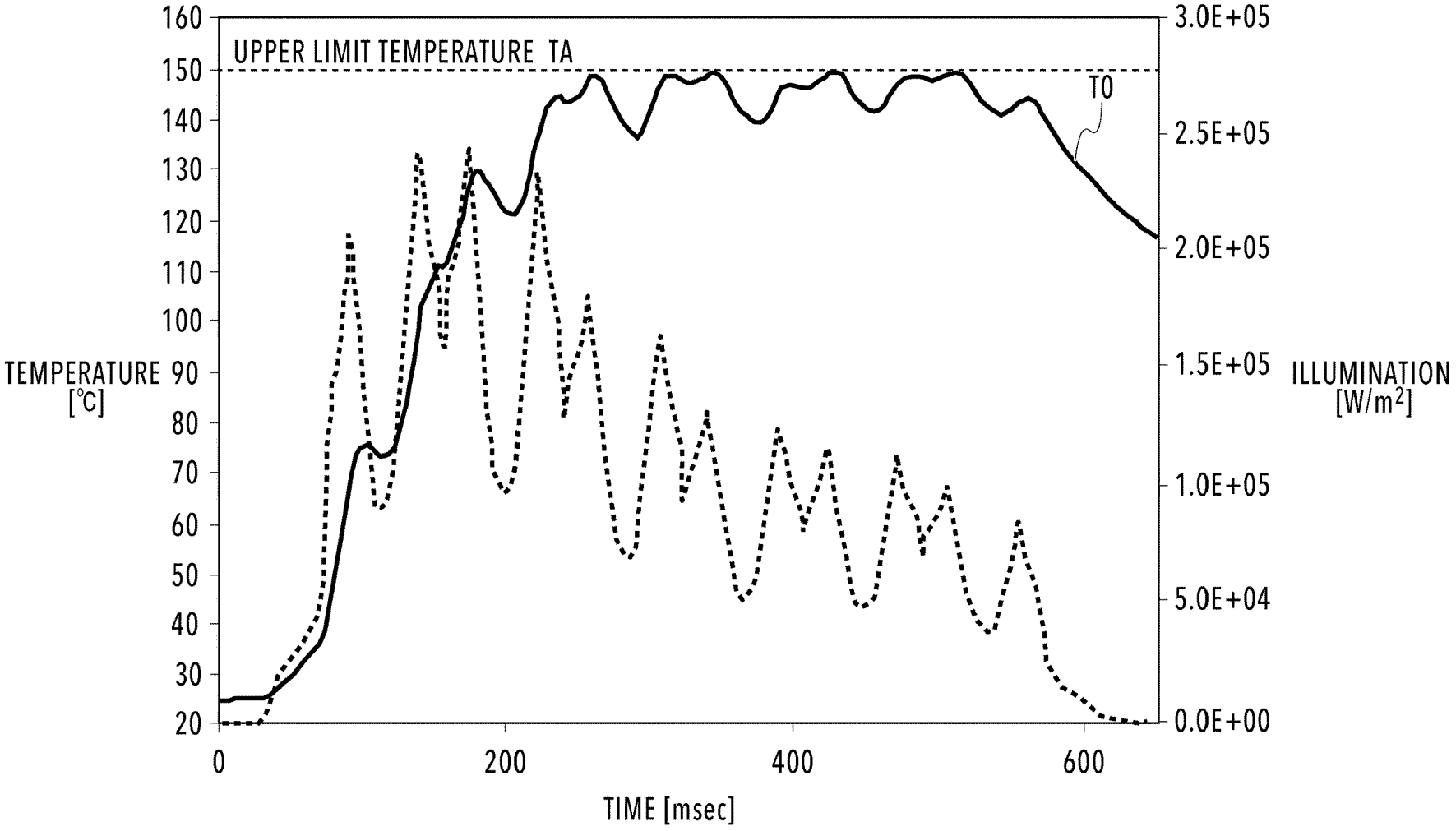
FIG. 12 is an explanatory diagram of a relationship between a surface temperature and an illumination distribution of an intermediate transfer body in a third embodiment of the invention.

In this embodiment, the ratios of the input power with respect to the six halogen lamps 81(*a*) to 86(*a*) immediately after the printing apparatus is started up are R1=100%, R2=100%, R3=70%, R4=51%, R5=48%, and R6=40%. FIG. 12 is an explanatory diagram of the surface temperature T0 and the illumination distribution of the intermediate transfer body immediately after the printing apparatus is started up under such a condition. The maximum input power of 100% (R1=R2=100%) is input to the halogen lamps 81(*a*) and 82(*a*), and thus, as illustrated in FIG. 12, the surface temperature T0 of the intermediate transfer body promptly increases up to the upper limit temperature TA(1). After that, the surface temperature T0 of the intermediate transfer body is retained to a temperature of approximately the upper limit temperature TA(1), according to the halogen lamps 83(*a*) to 86(*a*) having the ratios of the input power of R3=70%, R4=51%, R5=48%, and R6=40%. Thus, a large heat quantity is applied to the intermediate transfer body immediately after the printing apparatus is started up.

Figure 13:
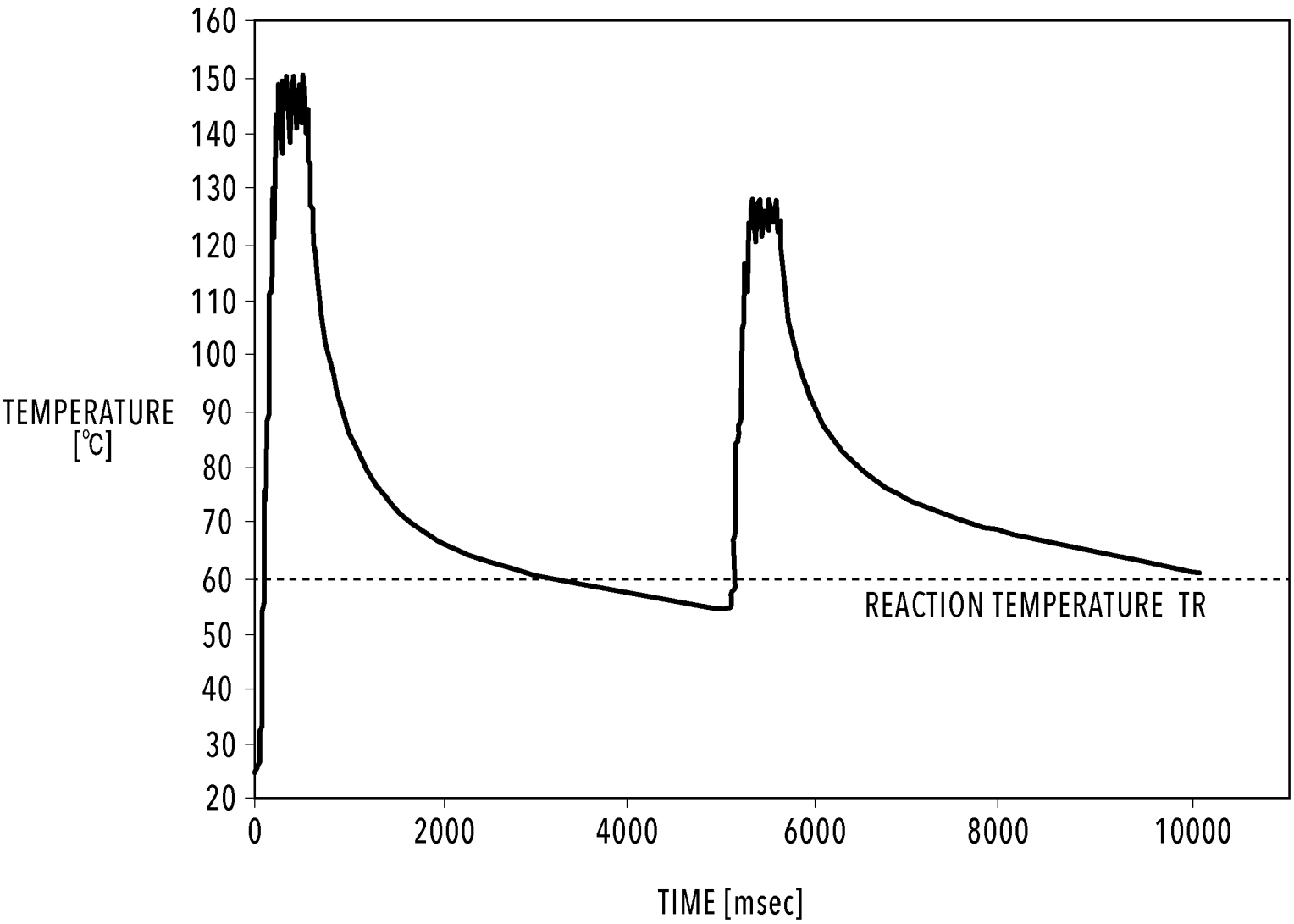
FIG. 13 is an explanatory diagram of the surface temperature of the intermediate transfer body in the third embodiment of the invention.

FIG. 13 is an explanatory diagram of a change in the surface temperature of the intermediate transfer body in a case where the input power with respect to the radiation heating unit 10 is controlled such that the surface temperature T0 of the intermediate transfer body is lower than or equal to the upper limit temperature TA(1), and is a reaction temperature TR (=60° C.) at which the reaction liquid and the ink excellently react to each other. In this example, the intermediate transfer body rotates two times after the printing apparatus is started up, and thus, the surface temperature T0 becomes the reaction temperature TR. Therefore, as with the second embodiment described above, the ratios of the input power with respect to six halogen lamps 81(*a*) to 86(*a*) are set from the third rotation of the intermediate transfer body. As described above, the first rotation of the intermediate transfer body is R1=100%, R2=100%, R3=70%, R4=51%, R5=48%, and R6=40%. The second rotation of the intermediate transfer body is R1=60%, R2=60%, R3=42%, R4=30.6%, R5=28.8%, and R6=24%.

(9) Comparative Example 5

Figure 14:
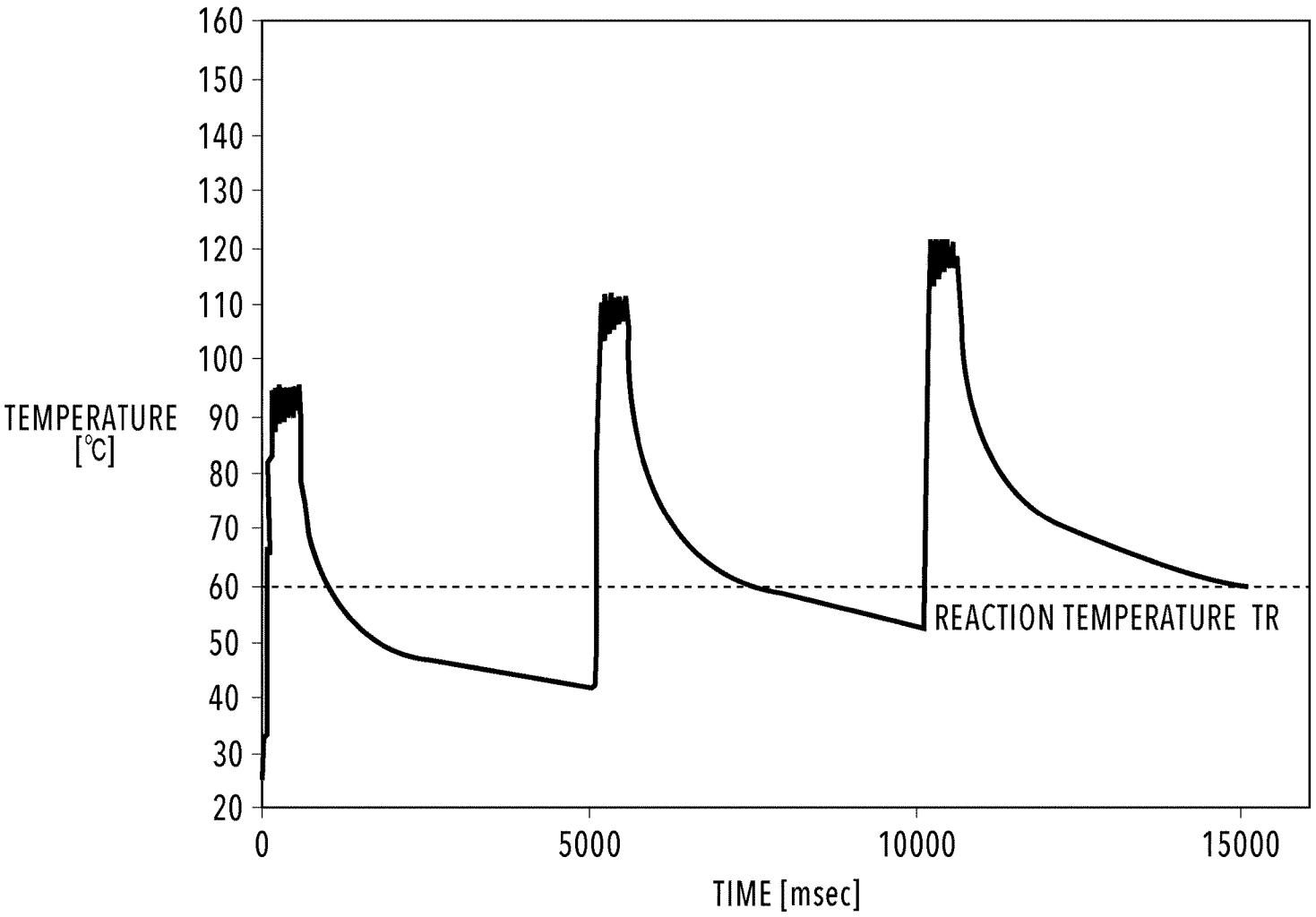
FIG. 14 is an explanatory diagram of a surface temperature of an intermediate transfer body in Comparative Example 5.

FIG. 14 is an explanatory diagram of a change in the surface temperature of the intermediate transfer body in a case where the heating condition during the printing operation of the first embodiment of the invention described above, is also set at the time of the warming up, as Comparative Example 5. That is, all of the heating conditions at the time of the warming up and during the printing operation after the warming up, are R1=84%, R2=46%, R33=32%, R4=28%, R5=25%, and R6=22%. The intermediate transfer body is heated according to such a heating condition, and thus, the heat of the intermediate transfer body is accumulated, and the temperature thereof increases up to approximately the reaction temperature TR (=60° C.). However, time for three times rotating of the intermediate transfer body is necessary until the surface temperature of the intermediate transfer body becomes the reaction temperature TR, according to the heating condition at the time of the warming up. On the other hand, in the third embodiment of the invention, as described above, the surface temperature of the intermediate transfer body becomes the reaction temperature TR according to the two times rotation of the intermediate transfer body.

As described above, during the printing operation, the heating condition may be set in consideration of the upper limit temperature TA affecting a chemical reaction between the reaction liquid and the intermediate transfer body, and during the warming up, the heating condition may be set in consideration of the upper limit temperature TA(1) affecting the heat resistance of the member itself of the intermediate transfer body. Accordingly, it is possible to efficiently heat the intermediate transfer body while ensuring the transfer properties, the toughness, and the durability of the ink image. In addition, the heating condition is gradually changed from the heating condition at the time of the warming up to the heating condition at the time of the printing operation, and thus, it is possible to more efficiently perform the warming up. In the third embodiment, the upper limit temperature TA(1) is set according to a curing temperature of the surface layer of the intermediate transfer body. The upper limit temperature TA(1) is different according to a manufacturing method and a structure of the intermediate transfer body. The upper limit temperature TA(1) can be set according to a heat resistance characteristic or the like of the configuration member of the intermediate transfer body, and the same control can be performed on the basis of the upper limit temperature TA(1).

(Other Embodiments)

The embodiments which are described above can be applied to various image forming apparatuses including the ink supplying unit supplying the ink onto the surface of the intermediate transfer body, the heating unit heating the intermediate transfer body, and the transfer unit transferring the ink on the surface of the intermediate transfer body to the printing medium. The heating unit may include a plurality of heating sources positioned in the rotation direction of the intermediate transfer body by being shifted, and the number of heating sources may be greater than or equal to 2. The plurality of heating sources may include at least the following first and second heating sources heating the intermediate transfer body. A degree of heating the intermediate transfer body by the second heating source is higher than a degree of heating the intermediate transfer body by the first heating source, and the second heating source is positioned on an upstream side in the rotation direction from the first heating source. In addition, the plurality of heating sources may further include a third heating source heating the intermediate transfer body with a degree of heating higher than or equal to the degree of heating by the second source. The third heating source is positioned on the upstream side in the rotation direction of the intermediate transfer body from the second heating source. In addition, the plurality of heating sources may further include a fourth heating source heating the intermediate transfer body with a degree of heating lower than or equal to the degree of heating by the first heating source. The fourth heating source is positioned on a downstream side in the rotation direction from the first heating source.

In addition, a method of supplying the ink to the intermediate transfer body is not limited to the ink jet type method described above, but is an arbitrary method.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-110000, filed Jun. 2, 2017, which is hereby incorporated by reference wherein herein in its entirety.

What is claimed is:

1. An image forming apparatus comprising:

an ink supply unit configured to supply an ink onto a surface of an intermediate transfer body;

a heating unit configured to heat the intermediate transfer body; and a transfer unit configured to transfer the ink on the surface of the intermediate transfer body to a printing medium, the ink supply unit, the heating unit, and the transfer unit being successively arranged with respect to a rotation direction of the intermediate transfer body, wherein the heating unit includes a plurality of heating sources which are positioned relative to each other by being shifted in the rotation direction of the intermediate transfer body, and the plurality of heating sources includes:

a first heating source heating the intermediate transfer body; and a second heating source heating the intermediate transfer body, a degree of heating the intermediate transfer body by the second heating source being greater than a degree of heating the intermediate transfer body by the first heating source, the second heating source being positioned on an upstream side, with respect to the rotation direction of the intermediate transfer body, of the first heating source.

2. The image forming apparatus according to claim 1, wherein the heating unit further includes a third heating source heating the intermediate transfer body with a degree of heating that is greater than or equal to the degree of heating by the second heating source, the third heating source being positioned on the upstream side, with respect to the rotation direction of the intermediate transfer body, of the second heating source.

3. The image forming apparatus according to claim 2, wherein the heating unit further includes a fourth heating source heating the intermediate transfer body with a degree of heating that is less than or equal to the degree of heating by the first heating source, the fourth heating source being positioned on a downstream side, with respect to the rotation direction of the intermediate transfer body, of the first heating source.

4. The image forming apparatus according to claim 1, wherein, of the plurality of heating sources, a heating source positioned on the most upstream side, with respect to the rotation direction of the intermediate transfer body, heats the intermediate transfer body to a temperature higher than or equal to a lowermost film forming temperature of the ink.

5. The image forming apparatus according to claim 1, wherein, in at least one of the plurality of heating sources, a degree of heating the intermediate transfer body at a time of an image forming operation of the image forming apparatus is different from that at a time of warming up before the image forming operation.

6. The image forming apparatus according to claim 1, further comprising a reaction liquid supply unit configured to supply a reaction liquid containing an ink thickening component onto the surface of the intermediate transfer body, wherein the plurality of heating sources heats the intermediate transfer body to a temperature that is lower than or equal to an upper limit temperature, which is set in order to maintain durability of the intermediate transfer body with respect to the reaction liquid.

7. The image forming apparatus according to claim 1, further comprising a control unit configured to be capable of individually controlling the degrees of heating the intermediate transfer body by the plurality of heating sources.

8. The image forming apparatus according to claim 7, wherein the control unit individually controls power supply with respect to the plurality of heating sources.

9. The image forming apparatus according to claim 1, wherein the heating unit further includes a reflection portion which reflects radiation heat from the heating source towards the intermediate transfer body.

10. The image forming apparatus according to claim 1, wherein the ink supply unit includes an ink jet head which is capable of ejecting the ink.

11. The image forming apparatus according to claim 1, further comprising a supplying unit configured to supply electric power, wherein the supplying unit supplies electric power to the second heating source in an amount greater than that to the first heating source.

12. An image forming method comprising:

a supplying step of supplying an ink onto a surface of an intermediate transfer body, which rotates in a predetermined direction;

a heating step of heating the surface of the intermediate transfer body onto which the ink is supplied; and a transfer step of transferring the ink on the surface of the intermediate transfer body to a printing medium, wherein, in the heating step, the intermediate transfer body is heated by a plurality of heating sources, including a first heating source and a second heating source which are positioned relative to each other by being shifted in the predetermined direction, and the second heating source heats the intermediate transfer body with a degree of heating that is greater than a degree of heating by the first heating source with which the intermediate transfer body is heated, the second heating source being positioned on an upstream side, with respect to the rotation direction of the intermediate transfer body, of the first heating source.

* * * * *